US010132494B2

(12) United States Patent
Nakaharai et al.

(10) Patent No.: US 10,132,494 B2
(45) Date of Patent: Nov. 20, 2018

(54) HEAT TRANSFER TUBE INCLUDING A GROOVE PORTION HAVING A SPIRAL SHAPE EXTENDING CONTINUOUSLY AND A RIB PORTION EXTENDING CONTINUOUSLY AND PROTRUDING INWARD BY THE GROOVE PORTION

(71) Applicant: MITSUBISHI HITACHI POWER SYSTEMS, LTD., Kanagawa (JP)

(72) Inventors: Hiroyuki Nakaharai, Tokyo (JP); Yuichi Kanemaki, Tokyo (JP); Kazuhiro Domoto, Kanagawa (JP); Yoshinori Yamasaki, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 101 days.

(21) Appl. No.: 15/107,561

(22) PCT Filed: Dec. 25, 2014

(86) PCT No.: PCT/JP2014/084238
§ 371 (c)(1),
(2) Date: Jun. 23, 2016

(87) PCT Pub. No.: WO2015/099009
PCT Pub. Date: Jul. 2, 2015

(65) Prior Publication Data

US 2016/0320052 A1 Nov. 3, 2016

(30) Foreign Application Priority Data

Dec. 27, 2013 (JP) ..... 2013-272804
Apr. 11, 2014 (JP) ..... 2014-082139
Nov. 7, 2014 (JP) ..... 2014-227415

(51) Int. Cl.
*F22B 37/10* (2006.01)
*F22B 1/18* (2006.01)
(Continued)

(52) U.S. Cl.
CPC ..... *F22B 37/103* (2013.01); *F01K 7/32* (2013.01); *F22B 1/18* (2013.01); *F22B 3/08* (2013.01);
(Continued)

(58) Field of Classification Search
CPC ..... F01K 7/32; F22B 29/067; F22B 37/101–37/103; F22B 37/12; F28F 1/40
(Continued)

(56) References Cited

U.S. PATENT DOCUMENTS 3,830,087 A * 8/1974 Nakamura ..... B21C 37/20 72/114
3,889,470 A * 6/1975 Szewalski ..... F01K 7/32 60/647
(Continued)

FOREIGN PATENT DOCUMENTS

DE 196 02 680 7/1997
DE 198 58 780 7/2000
(Continued)

OTHER PUBLICATIONS

Iwabuchi et al. "Heat transfer characteristics of rifled tube in near critical pressure region". Presented at The Seventh International Heat Transfer Conference, Munchen, Germany, Sep. 6-10, 1982.*
(Continued)

*Primary Examiner* — Laert Dounis
(74) *Attorney, Agent, or Firm* — Wenderoth, Lind & Ponack, L.L.P.

(57) ABSTRACT

A heat transfer tube for a boiler, an interior of the heat transfer tube having a supercritical pressure and being
(Continued)

configured to have a heating medium flow therethrough, includes: a groove portion defined on an inner circumferential surface and having a spiral shape extending continuously toward a tube axis direction; and a rib portion extending continuously and protruding inward in a radial direction by the groove portion of the spiral shape. In a cross section taken along the tube axis direction, a width of the groove portion in the tube axis direction is defined as Wg, a height of the rib portion in the radial direction is defined as Hr and a tube outer diameter is defined as D, and the width Wg of the groove portion, the height Hr of the rib portion, and the tube outer diameter D satisfy Wg/(Hr·D)>0.40.

17 Claims, 11 Drawing Sheets

(51) Int. Cl.

| | |
|---|---|
| ***F22B 29/06*** | (2006.01) |
| ***F22B 3/08*** | (2006.01) |
| ***F01K 7/32*** | (2006.01) |
| ***F22B 37/12*** | (2006.01) |
| ***F28F 1/40*** | (2006.01) |
| ***F28B 1/00*** | (2006.01) |

(52) U.S. Cl.
CPC ..... *F22B 29/061* (2013.01); *F22B 29/067* (2013.01); *F22B 37/12* (2013.01); *F28B 1/00* (2013.01); *F28F 1/40* (2013.01)

(58) Field of Classification Search
USPC ..... 122/235.14
See application file for complete search history.

(56) References Cited

U.S. PATENT DOCUMENTS

| | | | |
|---|---|---|---|
| 5,390,631 | A | 2/1995 | Albrecht |
| 6,302,194 | B1 | 10/2001 | Kastner et al. |

FOREIGN PATENT DOCUMENTS

| | | | |
|---|---|---|---|
| DE | 10 2011 004 266 | | 8/2012 |
| FR | 1 288 755 | | 3/1962 |
| JP | 56-23603 | | 3/1981 |
| JP | 60-139106 | | 9/1985 |
| JP | 60-139107 | | 9/1985 |
| JP | 5-118507 | | 5/1993 |
| JP | 6-137501 | | 5/1994 |
| JP | 8-42805 | | 2/1996 |
| JP | 3857414 | | 12/2006 |
| JP | 3857414 | B2 * | 12/2006 |
| JP | 2010-133596 | | 6/2010 |

OTHER PUBLICATIONS

Extended European Search Report dated Feb. 23, 2017 in European Application No. 14874082.2.

I.E. Semenovker, "New Types of Boilers Manufactured by Mitsubishi for Supercritical- and Ultra-Supercritical-Pressure Power-Generating Units", Thermal Engineering, vol. 41, No. 8, Aug. 1, 1994, pp. 655-661, XP000675062.

Office Action dated Aug. 17, 2017 in Korean Application No. 10-2016-7020271, with English translation.

Written Opinion of the International Searching Authority dated Mar. 17, 2015 in International (PCT) Application No. PCT/JP2014/084238, with English translation.

International Search Report dated Mar. 17, 2015 in International (PCT) Application No. PCT/JP2014/084238.

Decision of a Patent Grant dated Jan. 5, 2014 in Japanese Application No. 2014-227415, with English translation.

Decision of a Patent Grant dated Sep. 10, 2014 in Japanese Application No. 2014-082139, with English translation.

* cited by examiner

HEAT TRANSFER TUBE INCLUDING A GROOVE PORTION HAVING A SPIRAL SHAPE EXTENDING CONTINUOUSLY AND A RIB PORTION EXTENDING CONTINUOUSLY AND PROTRUDING INWARD BY THE GROOVE PORTION

FIELD

The present invention relates to a heat transfer tube through which a heating medium such as water flows therein, a boiler and a steam turbine device.

BACKGROUND

Conventionally, as a heat transfer tube through which a heating medium such as water flows, a tube with an inner surface fin equipped with a fin for forming multi-screws on an inner surface has been known (for example, see Japanese Patent Publication No. 5-118507). The interior of the tube with the inner surface fin has a subcritical pressure. In some cases, water flowing through the interior of the tube with the inner surface fin having the subcritical pressure is subjected to film boiling by heating the heat transfer tube. When the film boiling occurs, since the heat transfer decreases by a steam film formed on the inner surface of the tube, the temperature of the tube increases. Therefore, in the tube with the inner surface fin, the fin has a predetermined shape so as to suppress the temperature rise of the tube due to the film boiling. Specifically, the tube with the inner surface fin is configured so that a lead of the fin is 0.9 times a square root of an average tube inner diameter at a maximum level or a radial height of the fin is 0.04 times the average tube inner diameter at a minimum level.

Furthermore, as a heat transfer tube used in a once-through type steam generator of a supercritical pressure variable pressure operation type, a water-wall tube (rifled tube) of a water-cooled tube wall group has been known (for example, see Japanese Patent Publication No. 6-137501). The rifled tube is provided with a spiral projection on its inner surface. The once-through type steam generator performs a subcritical pressure operation in a partial load operation, and by providing the spiral projection on the inner surface of the rifled tube, the tube wall temperature of the rifled tube is kept below an allowable temperature at the time of subcritical pressure operation.

Technical Problem

In this way, when the interior of the heat transfer tube such as the tube with the inner surface fin described in Japanese Patent Publication No. 5-118507 is in a state of subcritical pressure, in order to suppress the temperature rise of the tube due to the film boiling, the fin has a predetermined shape. Similarly, in order to keep the tube wall temperature of the rifled tube below an allowable temperature at the time of subcritical pressure operation, the rifled tube described in Japanese Patent Publication No. 6-137501 is provided with a spiral projection on the inner surface.

Meanwhile, in some cases, the heat transfer tube flows water as a heating medium, in a state in which its interior has the supercritical pressure. Water flowing at the supercritical pressure is not boiled even if it is heated (does not enter a gas-liquid two-phase state), and flows through the interior of the heat transfer tube in a single-phase state. Here, when water flowing through the interior of the heat transfer tube having the supercritical pressure has a low mass velocity (a low flow velocity) or a high heat flux is applied to water at the time of heating the heat transfer tube, a heat transfer degradation phenomenon occurs in which a heat transfer coefficient decreases in some cases. When the heat transfer degradation phenomenon occurs, since the heat transfer from the heat transfer tube to water decreases, the temperature of the heat transfer tube is liable to increase.

Moreover, in the heat transfer tube having the supercritical internal pressure, when the heat transfer coefficient is low, since the heat transfer coefficient from the heat transfer tube to water decreases, the temperature of the heat transfer tube is liable to rise. Here, in Japanese Patent Publication No. 5-118507, a fin has a shape based on the premise that the interior of the heat transfer tube is in a state of subcritical pressure, that is, that the interior of the heat transfer tube is in the gas-liquid two-phase state. For this reason, since the shape of the fin is not based on the premise that the interior of the heat transfer tube is in the single-phase state, it is difficult to suppress the temperature rise of the heat transfer tube even by applying the invention of Japanese Patent Publication No. 5-118507.

SUMMARY

Thus, an object of the present invention is to provide a heat transfer tube, a boiler and a steam turbine device capable of suppressing an increase in the tube temperature, by suppressing an occurrence of heat transfer degradation phenomenon during supercritical pressure.

Furthermore, another object of the present invention is to provide a heat transfer tube, a boiler and a steam turbine device capable of suppressing an increase in the tube temperature, by improving the heat transfer coefficient, while suppressing an occurrence of heat transfer degradation phenomenon during supercritical pressure.

Solution to Problem

According to an aspect of the present invention, a heat transfer tube which is provided in a boiler, an interior of the heat transfer tube having a supercritical pressure and a heating medium flowing through the interior includes: a groove portion that is formed on an inner circumferential surface and has a spiral shape toward a tube axis direction; and a rib portion that is formed to protrude inward in a radial direction by the groove portion of the spiral shape. In a cross section taken along the tube axis direction, when a width [mm] of the groove portion in the tube axis direction is defined as Wg, a height [mm] of the rib portion in the radial direction is defined as Hr, and a tube outer diameter [mm] is defined as D, the width Wg [mm] of the groove portion, the height Hr [mm] of the rib portion, and the tube outer diameter D [mm] satisfy "$Wg/(Hr \cdot D)>0.40$".

According to this configuration, when the interior becomes a supercritical pressure, by satisfying $Wg/(Hr \cdot D)>0.40$, it is possible to suppress the occurrence of the heat transfer degradation phenomenon. For this reason, since the occurrence of the heat transfer degradation phenomenon can be suppressed during supercritical pressure, it is possible to suppress an increase in tube temperature.

Advantageously, in the heat transfer tube, when the boiler is operated at a rated output, an average mass velocity of the heating medium flowing through the interior of the heat transfer tube forming the furnace wall becomes 1000 to 2000 $kg/m^2s$.

According to this configuration, even when the heating medium such as water flowing through the interior of the heat transfer tube has a low mass velocity, or high heat flux is applied to the heating medium, it is possible to suppress an occurrence of the heat transfer degradation phenomenon.

Advantageously, in the heat transfer tube, when an interval [mm] of the rib portion in the tube axis direction is defined as Pr, the number of the rib portion in a cross section which is taken perpendicularly to the tube axis direction is defined as Nr, and a wetted perimeter length [mm] of the cross section which is taken perpendicularly to the tube axis direction is defined as L, the height Hr [mm] of the rib portion, the interval Pr [mm] of the rib portion, the number of the rib portion Nr and the wetted perimeter length L [mm] satisfy "(Pr·Nr)/Hr>1.25 L+55".

According to this configuration, when the interior becomes the supercritical pressure, by satisfying (Pr·Nr)/Hr>1.25 L+55, it is possible to suppress the occurrence of the heat transfer degradation phenomenon. Thus, since the occurrence of the heat transfer degradation phenomenon can be suppressed during supercritical pressure, it is possible to suppress an increase in tube temperature.

Advantageously, in the heat transfer tube, when the boiler is operated at a rated output, the average mass velocity of the heating medium flowing through the interior of the heat transfer tube forming the furnace wall is equal to or less than 1500 kg/m$^2$s.

According to this configuration, even when the mass velocity of the heating medium that flows through the interior of the heat transfer tube is lowered, it is possible to suppress the occurrence of the heat transfer degradation phenomenon.

Advantageously, in the heat transfer tube, the tube outer diameter D [mm] is "25 mm≤D≤40 mm".

According to this configuration, if the tube outer diameter is 25 mm to 40 mm, the effect is more remarkable.

According to another aspect of the present invention, a heat transfer tube which is provided in a boiler, an interior of the heat transfer tube having a supercritical pressure and a heating medium flowing through the interior includes: a groove portion that is formed on an inner circumferential surface and has a spiral shape toward a tube axis direction; and a rib portion that is formed to protrude inward in a radial direction by the groove portion of the spiral shape. When a height [mm] of the rib portion in the radial direction is defined as Hr, an interval [mm] of the rib portion in the tube axis direction is defined as Pr, the number of the rib portion in the cross section which is taken perpendicularly to the tube axis direction is defined as Nr, and a wetted perimeter length [mm] of the cross section which is taken perpendicularly to the tube axis direction is defined as L, the height Hr [mm] of the rib portion, the interval Pr [mm] of the rib portion, the number Nr of the rib portion and the wetted perimeter length L [mm] satisfy "(Pr·Nr)/Hr>1.25 L+55".

According to this configuration, when the interior becomes a supercritical pressure, by satisfying (Pr·Nr)/Hr>1.25 L+55, it is possible to suppress the occurrence of the heat transfer degradation phenomenon. For this reason, since the occurrence of the heat transfer degradation phenomenon can be suppressed during supercritical pressure, it is possible to suppress an increase in tube temperature.

Advantageously, in the heat transfer tube, when the boiler is operated at a rated output, an average mass velocity of the heating medium flowing through the interior of the heat transfer tube forming the furnace wall is equal to or less than 1500 kg/m$^2$s.

According to this configuration, even when the mass velocity of the heating medium that flows through the interior of the heat transfer tube is lowered, it is possible to suppress the occurrence of the heat transfer degradation phenomenon.

Advantageously, in the heat transfer tube, in a cross section taken along the tube axis direction, when a width [mm] of the groove portion in the tube axis direction is defined as Wg, and a tube outer diameter [mm] is defined as D, the width Wg [mm] of the groove portion, the height Hr [mm] of the rib portion, and the tube outer diameter D [mm] satisfy "Wg/(Hr·D)>0.40".

According to this configuration, when the interior becomes a supercritical pressure, by satisfying Wg/(Hr·D)>0.40, it is possible to suppress the occurrence of the heat transfer degradation phenomenon. For this reason, since the occurrence of the heat transfer degradation phenomenon can be suppressed during supercritical pressure, it is possible to suppress an increase in tube temperature.

Advantageously, in the heat transfer tube, when the boiler is operated at a rated output, an average mass velocity of the heating medium flowing through the interior of the heat transfer tube forming the furnace wall becomes 1000 to 2000 kg/m$^2$s.

According to this configuration, even if the heating medium such as water flowing through the interior of the heat transfer tube has a low mass velocity, or a high heat flux is applied to the heating medium, it is possible to suppress the occurrence of the heat transfer degradation phenomenon.

Advantageously, in the heat transfer tube, the tube outer diameter D [mm] is "25 mm≤D≤40 mm".

According to this configuration, if the tube outer diameter is 25 mm to 40 mm, the effect is more remarkable.

According to still another aspect of the present invention, a heat transfer tube which is provided in a boiler, an interior of the heat transfer tube having a supercritical pressure and a heating medium flowing through the interior includes: a groove portion that is formed on an inner circumferential surface and has a spiral shape toward a tube axis direction; and a rib portion that is formed to protrude inward in a radial direction by the groove portion of the spiral shape. When a height [mm] of the rib portion in the radial direction is defined as Hr, an interval [mm] of the rib portion in the tube axis direction is defined as Pr, a width [mm] of the rib portion in a circumferential direction of the inner circumferential surface is defined as Wr, the number of the rib portion in the cross section which is taken perpendicularly to the tube axis direction is defined as Nr, a wetted perimeter length [mm] of the cross section which is taken perpendicularly to the tube axis direction is defined as L, a width [mm] of the groove portion in the tube axis direction of the cross section which is taken along the tube axis direction is defined as Wg, and a tube outer diameter [mm] is defined as D, the width Wg [mm] of the groove portion, the height Hr [mm] of the rib portion, and the tube outer diameter D [mm] satisfy "Wg/(Hr·D)>0.40", and the height Hr [mm] of the rib portion, the interval Pr [mm] of the rib portion, the width Wr [mm] of the rib portion, the number Nr of the rib portion and the wetted perimeter length L [mm] satisfy "(Pr·Nr)/(Hr·Wr)>0.40 L+9.0".

According to this configuration, when the interior becomes a supercritical pressure, it is possible to improve the heat transfer coefficient, while suppressing the occurrence of the heat transfer degradation phenomenon. For this reason, by improving the heat transfer coefficient while suppressing the occurrence of the heat transfer degradation phenomenon during supercritical pressure, it is possible to suppress an increase in tube temperature.

Advantageously, in the heat transfer tube, when the boiler is operated at a rated output, an average mass velocity of the heating medium flowing through the interior of the heat transfer tube forming the furnace wall becomes 1000 to 2000 $kg/m^2s$.

According to this configuration, even when the heating medium such as water flowing through the interior of the heat transfer tube has a low mass velocity, or a high heat flux is applied to the heating medium, it is possible to improve the heat transfer coefficient, while suppressing the occurrence of the heat transfer degradation phenomenon.

Advantageously, in the heat transfer tube, when the boiler is operated at the rated output, the average mass velocity of the heating medium flowing through the interior of the heat transfer tube forming the furnace wall is equal to or less than 1500 $kg/m^2s$.

According to this configuration, even when the mass velocity of the heating medium flowing through the interior of the heat transfer tube is lowered, it is possible to improve the heat transfer coefficient, while suppressing the occurrence of the heat transfer degradation phenomenon.

Advantageously, in the heat transfer tube, the tube outer diameter D [mm] is "25 mm≤D≤35 mm".

According to this configuration, if the tube outer diameter is 25 mm to 35 mm, the mass flow velocity of the heating medium can be set to at least any one of the above-described range, and the mass flow velocity of the heating medium can be set to the suitable mass flow velocity. Here, in the case of applying the heat transfer tube to a boiler, the mass flow velocity of the heating medium flowing through the interior is set to a predetermined mass flow velocity. In this case, in regard to a defined mass flow velocity, when the tube outer diameter decreases, the mass flow velocity increases, and meanwhile, when the tube outer diameter increases, the mass flow velocity decreases. For this reason, in order to achieve the mass flow velocity suitable for the shape of the heat transfer tube that satisfies the above-described formula, by setting the tube outer diameter in the range of 25 mm to 35 mm, the defined mass flow velocity can be achieved, and it is possible to optimize the performance of the heat transfer coefficient.

Advantageously, in the heat transfer tube, the height Hr [mm] of the rib portion, the interval Pr [mm] of the rib portion, the width Wr [mm] of the rib portion, the number Nr of the rib portion and the wetted perimeter length L [mm] satisfy "$(Pr \cdot Nr)/(Hr \cdot Wr) < 0.40\ L+80$".

According to this configuration, in the formula of "$(Pr \cdot Nr)/(Hr \cdot Wr) > 0.40\ L+9.0$", when the formula of the left side extremely increases, an interval Pr of the rib portion widens, the number Nr of the rib portion increases, a height Hr of the rib portion becomes zero, and a width Wr of the rib portion in a circumferential direction becomes zero. Accordingly, it is not easy to maintain the shape of the heat transfer tube. For this reason, by satisfying the formula "$(Pr \cdot Nr)/(Hr \cdot Wr) < 0.40\ L+80$", it is possible to easily maintain the heat transfer tube in a suitable shape.

According to still another aspect of the present invention, a boiler includes the heat transfer tube according to any one of the above that is used as the furnace wall tube that forms a furnace wall of the boiler operated at a supercritical pressure, when operated at a rated output.

According to this configuration, the heat transfer tube can be applied as a furnace wall tube that forms a furnace wall of the boiler. In addition, such a furnace wall tube may also be referred to as a rifled tube.

According to still another aspect of the present invention, a boiler which heats the heating medium flowing through the interior of the heat transfer tube, by heating the heat transfer tube according to any one of the above by radiation of flame or high-temperature gas.

According to this configuration, it is possible to suppress an occurrence of heat transfer degradation phenomenon of the heat transfer tube during supercritical pressure, or to improve heat transfer coefficient, while suppressing the occurrence of the heat transfer degradation phenomenon of the heat transfer tube. For this reason, it is possible to suitably maintain the heat transfer from the heat transfer tube to the water as a heating medium, and it is possible to stably generate steam from water. In addition, for example, the high-temperature gas may be a combustion gas that is generated by combusting the fuel, and may be a flue gas discharged from a device such as a gas turbine. In other words, as a boiler using a heat transfer tube in which the interior becomes a supercritical pressure, for example, a supercritical pressure variable pressure operation boiler, a supercritical pressure constant pressure operation boiler or the like may be applied which heats the heat transfer tube by radiation of flame or combustion gas. In this case, the heat transfer tube is configured as furnace wall of a furnace provided in the boiler, by arranging a plurality of the heat transfer tubes in the radial direction. Furthermore, as another boiler that uses the heat transfer tube in which the interior becomes a supercritical pressure, for example, an exhausted heat recovery boiler which heats the heat transfer tube by the flue gas may be applied. In this case, the heat transfer tube is configured as the plurality of heat transfer tube groups arranged in the radial direction, and is housed in a container through which the flue gas flows. In this way, the heat transfer tube may be applied to any boiler, as long as the interior of a boiler becomes a supercritical pressure.

According to still another aspect of the present invention, a steam turbine device includes: the boiler according to any one of the above; and a steam turbine that is operated by steam generated by heating of water as the heating medium which flows through the interior of the heat transfer tube provided in the boiler.

According to this configuration, it is possible to suppress the occurrence of the heat transfer degradation phenomenon of the heat transfer tube during supercritical pressure, or to improve the heat transfer coefficient, while suppressing the occurrence of the heat transfer degradation phenomenon of the heat transfer tube. For this reason, it is possible to suitably maintain the heat transfer from the heat transfer tube to the water, and the steam can be stably generated. For this reason, since it is possible to stably supply the steam to the steam turbine, it is also possible to stably operate the steam turbine.

DESCRIPTION OF EMBODIMENTS

Embodiments according to the present invention will be described below in detail based the drawings. In addition, the present invention is not to be limited by the embodiments. In addition, constituent elements in the embodiments include those capable of being easily replaced by those skilled in the art, or those substantially identical thereto. Furthermore, the constituent elements described below can be appropriately combined with each other, and when there is a plurality of embodiments, it is also possible to combine the embodiments.

First Embodiment

Figure 1:
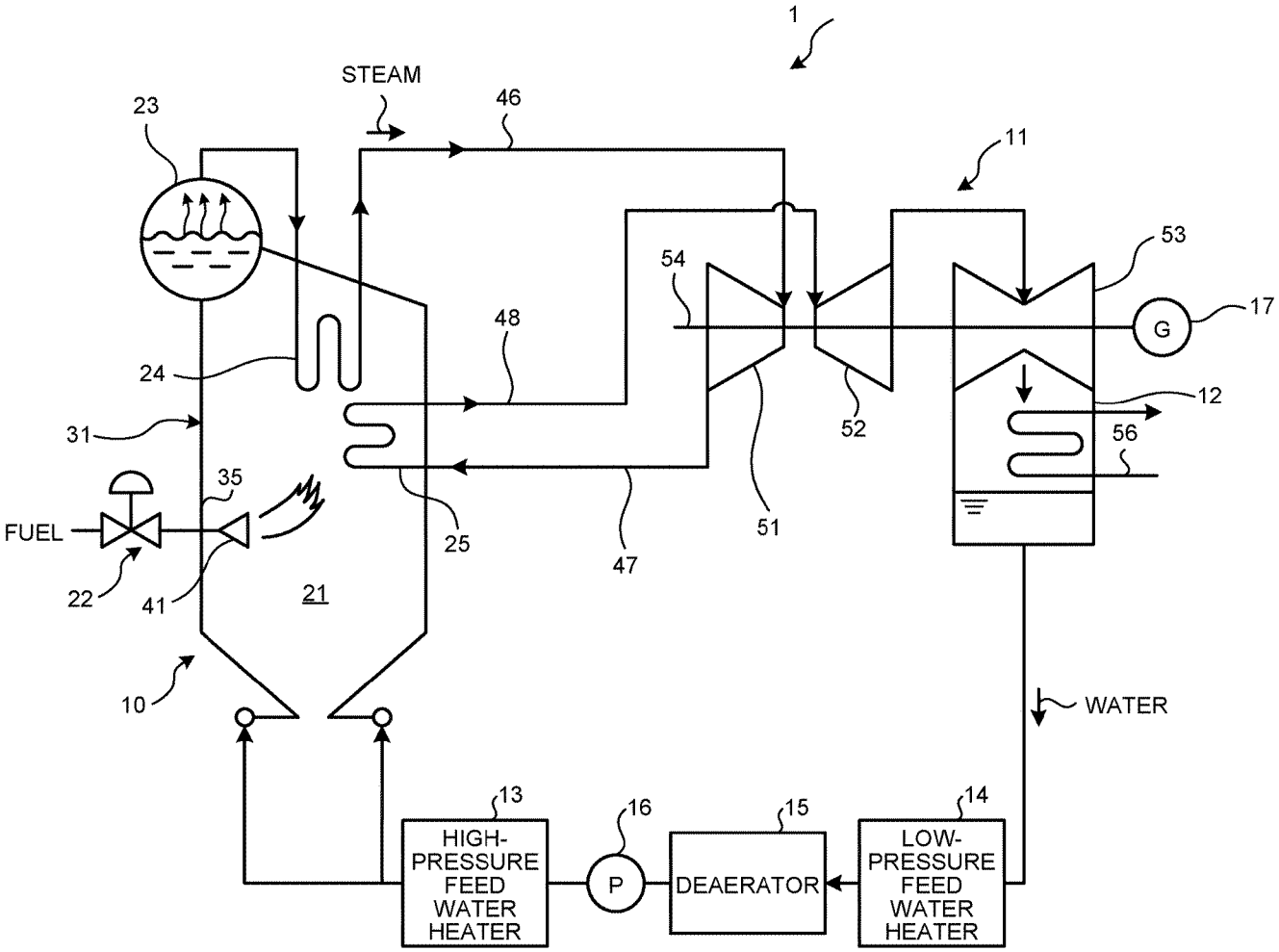
FIG. 1 is a schematic diagram illustrating a thermal power plant according to the first embodiment.
Figure 2:
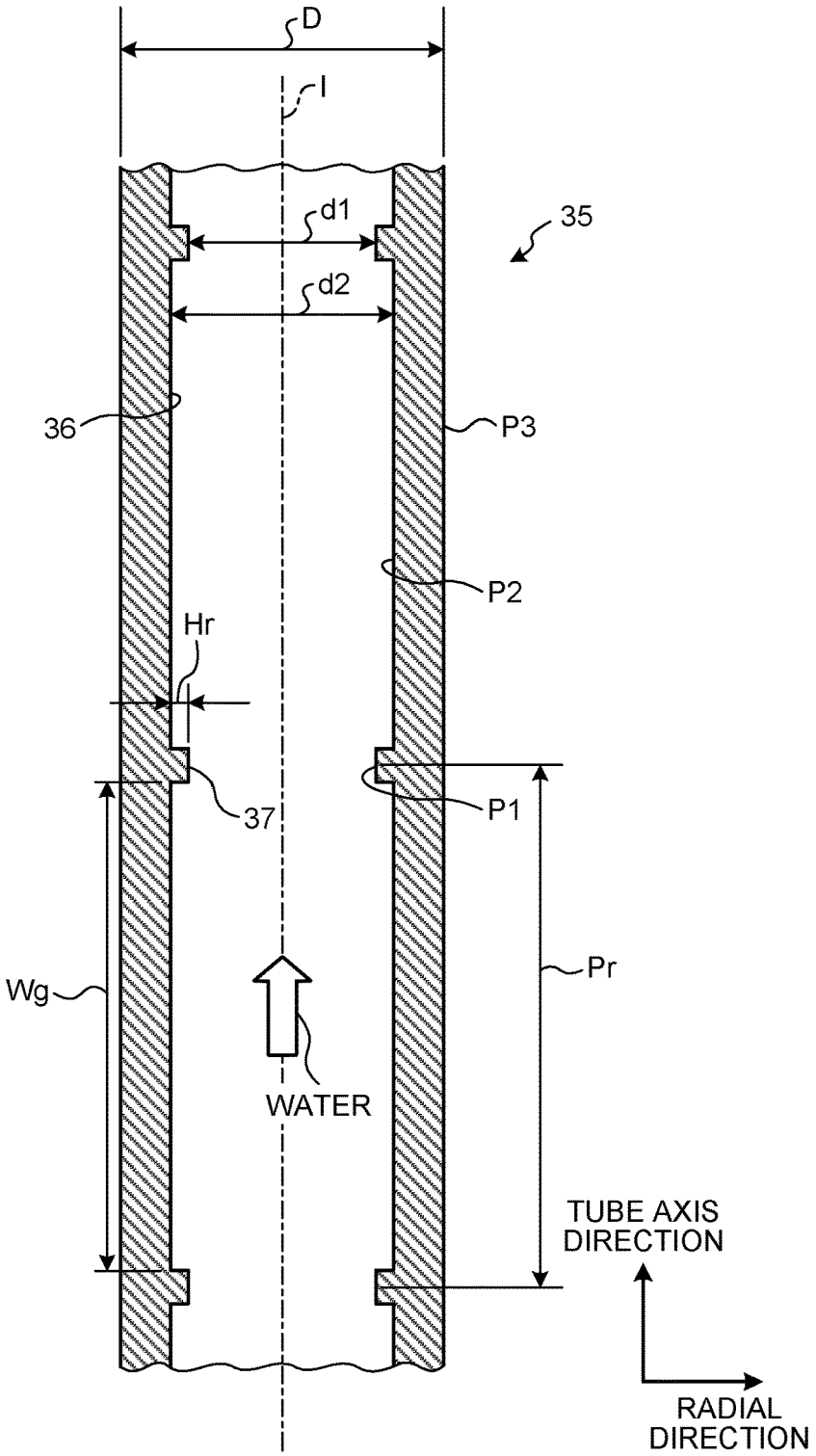
FIG. 2 is a cross-sectional view of a furnace wall tube when taken along a tube axis direction of the furnace wall tube.
Figure 3:
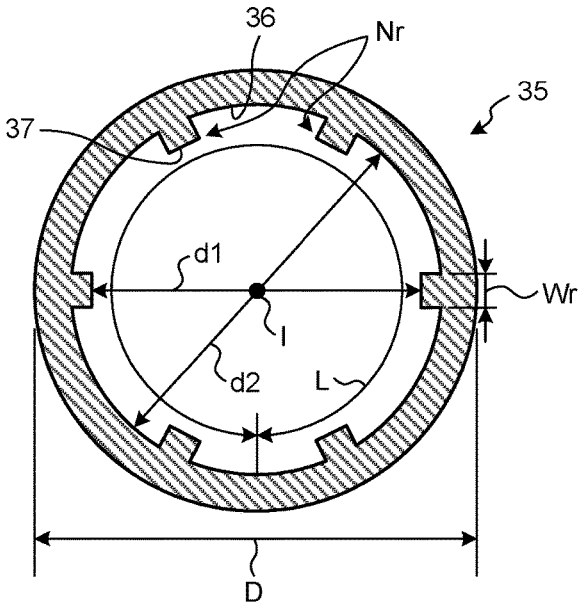
FIG. 3 is a cross-sectional view of the furnace wall tube when taken by a plane perpendicular to the tube axis direction of the furnace wall tube.

FIG. 1 is a schematic diagram illustrating a thermal power plant according to the first embodiment. FIG. 2 is a cross-sectional view of a furnace wall tube when taken along the tube axis direction of the furnace wall tube. FIG. 3 is a cross-sectional view of a furnace wall tube when taken by a plane perpendicular to the tube axis direction of the furnace wall tube.

The thermal power plant of the first embodiment uses pulverized coal obtained by crushing coal (such as bituminous, and subbituminous coal) as pulverized fuel (solid fuel). The thermal power plant combusts the pulverized coal to generate steam by heat generated by combustion, and drives a generator connected to the steam turbine to generate electric power, by rotating the steam turbine by the generated steam.

As illustrated in FIG. 1, a thermal power plant 1 is equipped with a boiler 10, a steam turbine 11, a condenser 12, a high-pressure feed water heater 13 and a low-pressure feed water heater 14, a deaerator 15, a feed water pump 16, and a generator 17. The thermal power plant 1 has a form of a steam turbine plant equipped with the steam turbine 11.

The boiler 10 is used as a conventional boiler, and is a pulverized coal-fired boiler that is capable of combusting the pulverized coal by a combustion burner 41 and recovering the heat generated by the combustion by the use of a furnace wall tube 35 that functions as a heat transfer tube. Furthermore, the boiler 10 is a supercritical pressure variable pressure operation boiler in which the interior of the furnace wall tube 35 is set to a supercritical pressure or a subcritical pressure. The boiler 10 is equipped with a furnace 21, a combustor 22, a steam separator 23, a superheater 24, and a repeater 25.

The furnace 21 has furnace walls 31 that surround the four sides, and is formed in a square tubular shape by the furnace walls 31 of the four sides. Moreover, in the furnace 21 having the square tubular shape, its extending longitudinal direction becomes a vertical direction and becomes perpendicular to an installation surface of the boiler 10. The furnace wall 31 is formed using a plurality of furnace wall tubes 35, and the plurality of furnace wall tubes 35 is disposed side by side in the radial direction so as to form the wall surfaces of the furnace walls 31.

Each furnace wall tube 35 is formed in a cylindrical shape, and its tube axis direction becomes the vertical direction and becomes perpendicular to the installation surface of the boiler 10. Further, the furnace wall tubes 35 are so-called rifled tubes in which spiral grooves are formed therein. Water as a heat transfer medium flows through the interior of the furnace wall tubes 35. The internal pressure of the furnace wall tubes 35 becomes a supercritical pressure or a subcritical pressure, depending on the operation of the boiler 10. The furnace wall tubes 35 are configured so that the lower side in the vertical direction is an inflow side, and the upper side in the vertical direction is an outflow side. In this way, the furnace 21 of the boiler 10 of the present embodiment is in a vertical tubular furnace type in which the furnace wall tubes 35 are perpendicular. The details of the furnace wall tubes 35 will be described below.

The combustor 22 has a plurality of combustion burners 41 mounted on the furnace wall 31. Furthermore, in FIG. 1, only one combustion burner 41 is illustrated. The plurality of combustion burners 41 combusts the pulverized coal as fuel to form flame in the furnace 21. At this time, the plurality of combustion burners 41 combusts the pulverized coal so that the formed flame becomes a turning flow. Moreover, the plurality of combustion burners 41 heats the furnace wall tubes 35, by the high-temperature combustion gas generated by combusting the fuel (high-temperature gas). In regard to the plurality of combustion burners 41, for example, the plurality of combustion burners arranged at a predetermined interval along the circumference of the furnace 21 are assumed to be a set, and a set of the combustion burners 41 is arranged in the plural stages at a predetermined interval in the vertical direction (longitudinal direction of the furnace 21).

The superheater 24 is provided inside the furnace 21 to superheat the steam supplied from the furnace wall tubes 35 of the furnace 21 via the steam separator 23. The steam superheated in the superheater 24 is supplied to the steam turbine 11 via a main steam pipe 46.

The reheater 25 is provided inside the furnace 21 to heat the steam used in (a high-pressure turbine 51 of) the steam turbine 11. The steam flowing into the reheater 25 from (the high-pressure turbine 51 of) the steam turbine 11 via a low-temperature reheat steam pipe 47 is heated by the reheater 25, and the heated steam flows into (an intermediate-pressure turbine 52 of) the steam turbine 11 from the reheater 25 again via a high-temperature reheat steam pipe 48.

The steam turbine 11 has the high-pressure turbine 51, the intermediate-pressure turbine 52, and a low-pressure turbine 53. These turbines 51, 52 and 53 are connected by a rotor 54 as a rotating shaft in an integrally rotatable manner. The main steam pipe 46 is connected to the inflow side of the high-pressure turbine 51, and the low-temperature reheat steam pipe 47 is connected to the outflow side thereof. The high-pressure turbine 51 rotates by the steam supplied from the main steam pipe 46, and discharges the steam after use from the low-temperature reheat steam pipe 47. The high-temperature reheat steam pipe 48 is connected to the inlet side of the intermediate-pressure turbine 52, and the low-pressure turbine 53 is connected to the outflow side thereof. The intermediate-pressure turbine 52 rotates by the steam supplied and reheated from the high-temperature reheat steam pipe 48, and discharges the steam after use toward the low-pressure turbine 53. The intermediate-pressure turbine 52 is connected to the inflow side of the low-pressure turbine 53, and the condenser 12 is connected to the outflow side thereof. The low-pressure turbine 53 rotates by the steam supplied from the intermediate-pressure turbine 52, and discharges the steam after use toward the condenser 12. The rotor 54 is connected to the generator 17, and rotationally drives the generator 17 by rotation of the high-pressure turbine 51, the intermediate-pressure turbine 52 and the low-pressure turbine 53.

The condenser 12 flocculates the steam discharged from the low-pressure turbine 53 by a cooling line 56 provided therein to return (condensate) the steam to water. The flocculated water is supplied toward the low-pressure feed water heater 14 from the condenser 12. The low-pressure feed water heater 14 heats the water flocculated by the condenser 12 in a low-pressure state. The heated water is supplied toward the deaerator 15 from the low-pressure feed water heater 14. The deaerator 15 deaerates water supplied from the low-pressure feed water heater 14. The deaerated water is supplied toward the high-pressure feed water heater 13 from the deaerator 15. The high-pressure feed water heater 13 heats the water deaerated by the deaerator 15 in a high-pressure state. The heated water is supplied toward the furnace wall tubes 35 of the boiler 10 from the high-pressure feed water heater 13. In addition, between the deaerator 15 and the high-pressure feed water heater 13, a feed water pump 16 is provided to supply water toward the high-pressure feed water heater 13 from the deaerator 15.

The generator 17 is connected to the rotor 54 of the steam turbine 11, and generates power by being rotationally driven by the rotor 54.

In addition, although it is not illustrated, the thermal power plant 1 is provided with a denitrification device, an electrostatic precipitator, an induced blower, and a desulfurization device, and a stack is provided at a downstream end portion.

In the thermal power plant 1 configured in this way, the water flowing through the interior of the furnace wall tubes 35 of the boiler 10 is heated by the combustor 22 of the boiler 10. Water heated by the combustor 22 is converted into steam until it flows into the superheater 24 through the steam separator 23, and the steam passes through the superheater 24 and main steam pipe 46 in this order and is supplied to the steam turbine 11. The steam supplied to the steam turbine 11 passes through the high-pressure turbine 51, the low-temperature reheat steam pipe 47, the repeater 25, the high-temperature reheat steam pipe 48, the intermediate-pressure turbine 52, and low-pressure turbine 53 in this order, and flows into the condenser 12. At this time, the steam turbine 11 rotates by the flowed steam, thereby rotationally driving the generator 17 via the rotor 54 to generate power in the generator 17. The steam flowed into the condenser 12 is returned to water by being flocculated by the cooling line 56. Water flocculated in the condenser 12 passes through the low-pressure feed water heater 14, the deaerator 15, the feed water pump 16, and the high-pressure feed water heater 13 in this order, and is supplied into the furnace wall tubes 35 again. In this way, the boiler 10 of this embodiment becomes a once-through boiler.

Next, the furnace wall tube 35 will be described referring to FIGS. 2 and 3. As illustrated in FIGS. 2 and 3, the furnace wall tube 35 is formed in a cylindrical shape around a center line I. As described above, the furnace wall tube 35 is provided so that its tube axis direction becomes a vertical direction, and the water flows therein toward the upper side from the lower side in the vertical direction. Also, on an inner circumferential surface P1 of the furnace wall tube 35 configured as a rifled tube, a groove portion 36 having a spiral shape toward the tube axis direction is formed. Further, in the furnace wall tube 35, a rib portion 37 projecting radially inward is formed to have a spiral shape toward the tube axis direction by the spiral groove portion 36. Here, a tube outer diameter of the furnace wall tube 35, that is, a diameter passing through the center line I on the outer circumferential surface P3 is set to a tube outer diameter D. In addition, the tube outer diameter D is a length of several ten millimeters order. Therefore, the unit of the tube outer diameter D is set to [mm].

A plurality of groove portions 36 is formed in the circumferential direction of the inner circumferential surface P1 at a predetermined interval, in a cross section illustrated in FIG. 3 which is taken along a plane perpendicular to the tube axis direction. In the first embodiment, six groove portions 36 are formed in the cross section illustrated in FIG. 3. Thus, six rib portions 37 are also formed in the cross section illustrated in FIG. 3. In the first embodiment, although the number of groove portions 36 formed on the furnace wall tube 35 is six, the plurality of groove portions 36 may be formed, and the number is not particularly limited.

Furthermore, since each groove portion 36 is formed to sink to the outside in the radial direction, the bottom surface (that is, the outside plane in the radial direction of the groove portion 36) of each groove portion 36 is an inner circumferential surface P2 that is located outside in the radial direction from the inner circumferential surface P1. The inner circumferential surface P2 has a circular shape around the center line I in the cross section illustrated in FIG. 3. That is, the inner circumferential surface P1 and the inner circumferential surface P2 are formed on a concentric circle, the inner circumferential surface P1 is located inside in the radial direction, and the inner circumferential surface P2 is located outside in the radial direction. Here, the diameter of the internal inner circumferential surface P1 of the furnace wall tube 35 is set to a small inner diameter d1, and the diameter of the external inner circumferential surface P2 of the furnace wall tube 35 is set to a large inner diameter d2.

Also, since each of the groove portions 36 is formed in a spiral shape toward the tube axis direction, a plurality of groove portions 36 is formed in the tube axis direction of the inner circumferential surface P1 at a predetermined interval, in the cross-section illustrated in FIG. 2 which is taken along the tube axis direction.

The plurality of rib portions 37 is formed in the circumferential direction of the inner circumferential surface P1 at a predetermined interval, in the cross section illustrated in FIG. 3 which is taken along a plane perpendicular to the tube axis direction. In the first embodiment, since the six groove portions 36 are formed, the six rib portions 37 are formed between the groove portions 36. In the first embodiment, although the number of the rib portions 37 formed on the furnace wall tube 35 is six, as in the groove portions 36, the plurality of rib portions 37 may be formed, and the number thereof is not particularly limited.

Furthermore, each of the rib portions 37 is formed to protrude inward in the radial direction from the bottom surface (that is, the inner circumferential surface P2) of the respective groove portions 36. Also, since the rib portions 37 are formed in a spiral shape toward the tube axis direction, the plurality of rib portions 37 is formed on the inner circumferential surface P2 in the tube axis direction at a predetermined interval, in the cross-section illustrated in FIG. 2 which is taken along the tube axis direction.

Here, as illustrated in FIG. 2, the height in the radial direction of the rib portion 37 is set to a rib height Hr. Specifically, the rib height Hr is a height from the inner circumferential surface P2 to a location (that is, top) at which the rib portion 37 is located on the radially innermost side. Furthermore, in the cross section illustrated in FIG. 3, the width in the circumferential direction of the rib portion 37 is set to a rib width Wr. Specifically, the rib width Wr is a width between a boundary between the inner circumferential surface P2 on one side in the circumferential direction of the rib portion 37 and a boundary between the inner circumferential surface P2 on the other side in the circumferential direction of the rib portion 37.

Also, in the cross section illustrated in FIG. 2, the width in the tube axis direction of the groove portion 36 is set to a groove width Wg, and the interval of the rib portions 37 adjacent to each other in the tube axis direction is set to a rib interval Pr. Specifically, the groove width Wg is a width between a boundary between the inner circumferential surface P2 and the rib portion 37 on one side in the tube axis direction of the groove portion 36, and a boundary between the inner circumferential surface P2 and the rib portion 37 on the other side in the tube axis direction of the groove portion 36. Furthermore, the interval Pr is a distance between the centers in the tube axis direction of the rib portions 37.

Furthermore, in the cross-section illustrated in FIG. 3, the contact length of the furnace wall tube 35 with the water flowing through the interior is set to a wetted perimeter length L, and the number of rib portions 37 is set to a rib number Nr. In FIG. 3, the wetted perimeter length L is viewed like a circumference for convenience of illustration, but it is a total length of the wall surface in contact with the fluid in a flow passage cross section as described above. At this time, the tube outer diameter D is the length of several ten millimeters order. Therefore, the rib height Hr becomes the height of the millimeter order. Similarly, the rib width Wr, the groove width Wg, the rib interval Pr and the wetted perimeter length L also become the length of the millimeter order. Therefore, the units of the rib height Hr, the rib width Wr, the groove width Wg, the rib interval Pr and the wetted perimeter length L are [mm].

Next, the shape of the furnace wall tube 35 will be described. As described above, water flows through the furnace wall tube 35 in a state in which its interior has a supercritical pressure. In this case, in the furnace wall tube 35 heated by the combustor 22, in some cases, the heat transfer degradation phenomenon in which the heat transfer coefficient is lowered occurs. Therefore, the furnace wall tube 35 is formed in a shape in which the small inner diameter d1, the large inner diameter d2, the tube outer diameter D, the groove width Wg, the rib width Wr, the interval Pr, the rib number Nr, the rib height Hr, and the wetted perimeter length L satisfy the relational formula described below.

In the furnace wall tube 35, the groove width Wg, the rib height Hr and the tube outer diameter D satisfy the relational formula "Wg/(Hr·D)>0.40". Here, in the case of "Wg/(Hr·D)=F", the relation "F>0.40" is obtained. At this time, the rib height Hr is "Hr>0", the rib portion 37 is configured to protrude radially inward. Moreover, the rib height Hr, the rib interval Pr, the rib number Nr and the wetted perimeter length L satisfy the relational formula of "(Pr·Nr)/Hr>1.25 L+55". Although the details will be described later, by setting the shape of the furnace wall tube 35 to satisfy the above-described relational formula, it is possible to suppress the occurrence of the heat transfer degradation phenomenon. At this time, if the tube outer diameter D is "25 mm≤D≤40 mm", more remarkable effect is achieved.

A lead angle of the rib portion 37 having the spiral shape becomes an angle that satisfies the above-mentioned relational formula. In addition, the lead angle is an angle with respect to the tube axis direction. If the lead angle of the rib portion 37 is 0°, it becomes a direction along the tube axis direction, and if the lead angle of the rib portion 37 is 90°, it becomes a direction along the circumferential direction. Here, the lead angle of the rib portion 37 is also appropriately changed depending on the number of rib portions 37. In other words, if there are a large number of rib portions 37, the lead angle of the rib portion 37 becomes a gentle angle (approaches 0°), and on the other hand, if there are a small number of rib portions 37, the lead angle of the rib portion 37 becomes a steep angle (approaches 90°).

Figure 4:
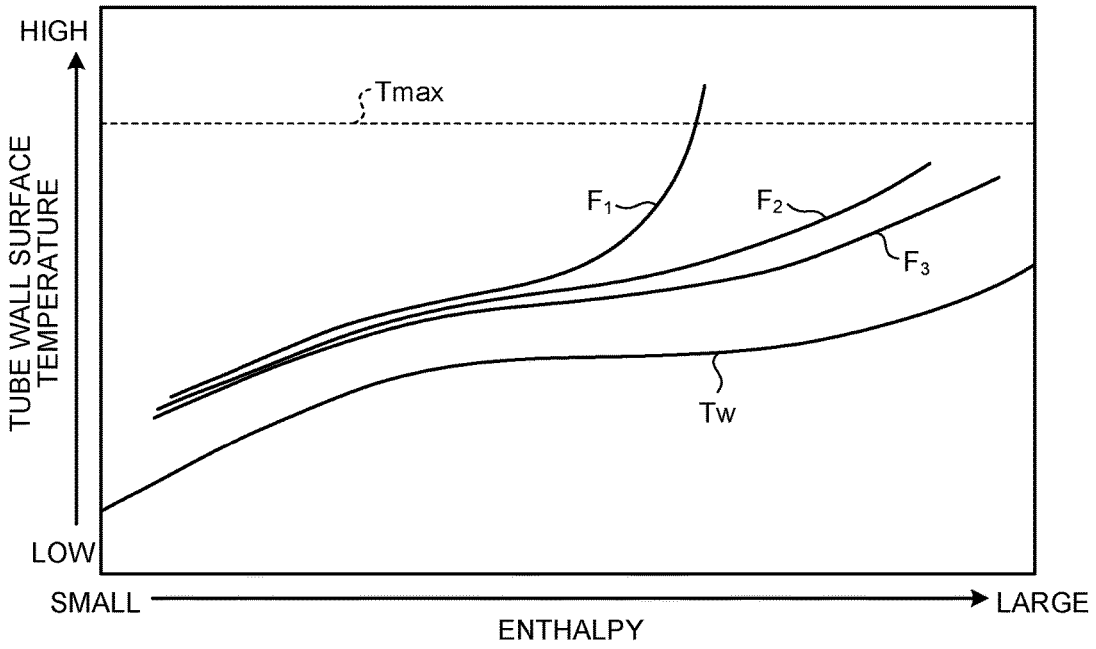
FIG. 4 is a graph of an example of a tube wall surface temperature of the furnace wall which varies depending on enthalpy.
Figure 5:
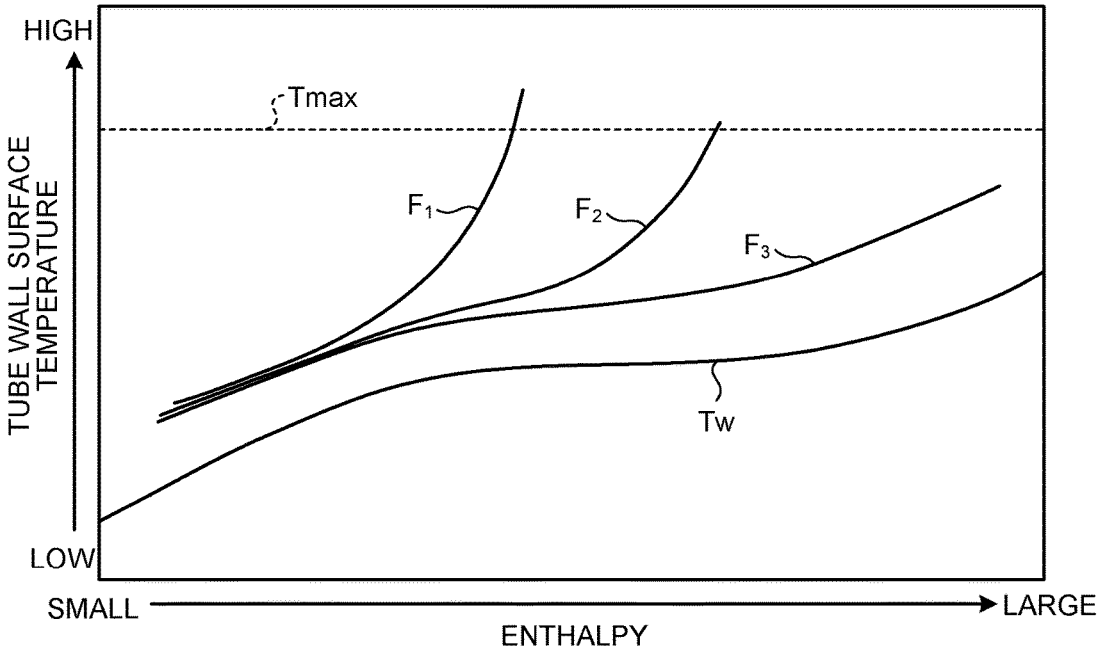
FIG. 5 is a graph of an example of the tube wall surface temperature of the furnace wall which varies depending on enthalpy.

Next, changes in tube wall surface temperature of the furnace wall which vary depending on the enthalpy will be described referring to FIGS. 4 and 5. FIGS. 4 and 5 are graphs of an example of the tube wall surface temperature of the furnace wall which varies depending on the enthalpy. Here, in FIGS. 4 and 5, the horizontal axes are enthalpy given to the furnace wall 31 (furnace wall tube 35), and the vertical axes thereof are the tube wall surface temperature (the temperature of the furnace wall tube 35).

As illustrated in FIGS. 4 and 5, $F_1$ is a graph illustrating a change in tube wall surface temperature at the time of "F=0.35", and has a shape of the conventional furnace wall tube 35 that does not satisfy the relational formula of this embodiment. Furthermore, $F_2$ is a graph illustrating a change in tube wall surface temperature at the time of "F>0.40", and has a shape of the furnace wall tube 35 that satisfies the relational formula of this embodiment. In addition, $F_3$ is a graph illustrating a change in tube wall surface temperature when satisfying the relational formula "(Pr·Nr)/Hr>1.25 L+55", and has another shape of the furnace wall tube 35 that satisfies the relational formula of this embodiment. In addition, $T_w$ is a graph illustrating a change in temperature (fluid temperature) of water that flows through the interior of the furnace wall tube 35, and $T_{max}$ is a critical tube temperature that is acceptable for the furnace wall tube 35.

Here, in FIG. 4, the mass velocity of water flowing through the interior of the furnace wall tube 35 becomes a low mass velocity at which flow stability of water inside the furnace wall tube 35 can be secured, and the interior of the furnace wall tube 35 has a supercritical pressure. Specifically, the low mass velocity differs depending on the sizes of the tube outer diameter D, the small inner diameter d1 and the large inner diameter d2, but for example, when operating the boiler 10 at the rated output, the average mass velocity of the furnace wall tube 35 is in a rage of 1000 (kg/m$^2$s) or more and 2000 (kg/m$^2$s) or less. In addition, as long as the mass flow velocity is achieved at which the flow stability of water inside the furnace wall tube 35 can be secured, the mass flow velocity is not limited to the above-described range. In this embodiment, the rated output has a rated electrical output in the generator of the thermal power plant 1.

As illustrated in FIG. 4, in the case of $F_1$, it is recognized that when the enthalpy increases, that is, when the amount of heat given to the furnace wall tube 35 increases, the tube wall surface temperature transiently increases. That is, in the case of $F_1$, it was checked that when the amount of heat given to the furnace wall tube 35 increases, the heat transfer degradation phenomenon occurs in which the heat transfer coefficient decreases during supercritical pressure.

Meanwhile, as illustrated in FIG. 4, in the case of $F_2$ and $F_3$, it is recognized that when the enthalpy increases, that is, when the amount of heat given to the furnace wall tube 35 increases, as compared to the case of $F_1$, the tube wall surface temperature gradually increases. That is, in the case of $F_2$ and $F_3$, it was checked that even when the amount of heat given to the furnace wall tube 35 increases, a decrease in heat transfer coefficient during supercritical pressure is suppressed, and it is possible to suppress the occurrence of the heat transfer degradation phenomenon in the furnace wall tube 35.

Next, in FIG. 5, the mass velocity of water flowing through the interior of the furnace wall tube 35 becomes slower than the case of FIG. 4, and becomes a minimum (lower limit) mass velocity at which the boiler 10 can be operated. In addition, similar to FIG. 4, the interior of the furnace wall tube 35 has a supercritical pressure. Specifically, the minimum mass velocity differs depending on the sizes of the tube outer diameter D, the small inner diameter d1 and the large inner diameter d2, but for example, when operating the boiler 10 at the rated output, the average mass velocity of the furnace wall tube 35 is in the range of 1500 (kg/m$^2$s) or less. In addition, if there is a minimum mass velocity that allows the operation of the boiler 10, it is not limited to the above-described range, but the general lower limit is about 700 kg/m$^2$s.

As illustrated in FIG. 5, in the case of $F_1$, it is recognized that when the enthalpy increases, that is, when the amount of heat given to the furnace wall tube 35 increases, the tube wall surface temperature transiently increases. That is, in the case of $F_1$, it was checked that the heating medium flows through the interior of the furnace wall tube 35 at the minimum mass velocity, and when the amount of heat given to the furnace wall tube 35 increases, the heat transfer degradation phenomenon occurs in which the heat transfer coefficient decreases during supercritical pressure.

Meanwhile, as illustrated in FIG. 5, in the case of $F_2$, it is recognized that when the enthalpy increases, that is, when the amount of heat given to the furnace wall tube 35 increases, as compared to the case of $F_1$, the tube wall surface temperature gradually increases but exceeds the critical tube temperature $T_{max}$. In contrast, in the case of $F_3$, when the enthalpy increases, that is, when the amount of heat given to the furnace wall tube 35 increases, as compared to the case of $F_2$, the tube wall surface temperature gradually increases. That is, it was checked that, in the case of $F_3$, in other words, when the shape of the furnace wall tube 35 satisfies the relational formula "(Pr·Nr)/Hr>1.25 L+55", the heating medium flows through the interior of the furnace wall tubes 35 at a minimum mass velocity, even when the amount of heat given to the furnace wall tube 35 increases, the decrease in the heat transfer coefficient during supercritical pressure is suppressed, and it is possible to suppress the occurrence of the heat transfer degradation phenomenon in the furnace wall tubes 35.

As described above, according to the configuration of first embodiment, in the furnace wall tubes 35 in which the interior becomes a supercritical pressure, even if water flowing through the interior of the furnace wall tubes 35 has a low mass velocity or the high heat flux is applied thereto, by satisfying the relation of Wg/(Hr·D)>0.40, as illustrated in FIG. 4, it is possible to suppress the occurrence of the heat transfer degradation phenomenon. Thus, since the occurrence of the heat transfer degradation phenomenon can be suppressed during supercritical pressure, it is possible to suppress an increase in the tube temperature of the furnace wall tube 35 (tube wall surface temperature of the furnace wall 31).

Also, according to the configuration of the first embodiment, even if the water flowing through the interior of the furnace wall tube 35 has the lower limit velocity, by satisfying the relational formula (Pr·Nr)/Hr>1.25 L+55, as illustrated in FIG. 5, it is possible to suppress the occurrence of the heat transfer degradation phenomenon. For this reason, even if water flows through the interior of the furnace wall tube 35 at the lower limit mass velocity during supercritical pressure, the occurrence of the heat transfer degradation phenomenon can be suppressed, and thus, it is possible to suppress an increase in the tube temperature of the furnace wall tube 35 (tube wall surface temperature of the furnace wall 31).

Also, according to the configuration of the first embodiment, the furnace wall tube 35 satisfying the above-mentioned relational formula can be applied to a supercritical pressure variable pressure operation boiler of a vertical tubular furnace type. Thus, since it is possible to suppress the occurrence of the heat transfer degradation of the furnace wall tube 35 during supercritical pressure, it is possible to suitably maintain the heat transfer from the furnace wall tube 35 to water and to stably generate the steam.

Also, according to the configuration of the first embodiment, the boiler 10 having the furnace wall tube 35 can be applied to the thermal power plant 1 that uses the steam turbine 11. For this reason, since the steam can be stably generated in the boiler 10, it is possible to stably supply the steam toward the steam turbine 11, and thus, it is possible to stably operate the steam turbine 11.

In the first embodiment, the furnace wall tube 35 which functions as the heat transfer tube is applied to the conventional boiler, and the conventional boiler is applied to the thermal power plant 1, but the present invention is not limited to this configuration. For example, the heat transfer tube which satisfies the above-mentioned relational formula may be applied to an exhausted heat recovery boiler, and the exhausted heat recovery boiler may be applied to an integrated coal gasification combined cycle (IGCC) plant. That is, as long as a once-through boiler is adopted in which the interior of the heat transfer tube has a supercritical pressure, it may be applied to any boiler.

Furthermore, in the first embodiment, although $F_2$ has the shape of the furnace wall tube 35 that satisfies the relational formula of "F>0.40", and $F_3$ has the shape of the furnace wall tube 35 that satisfies the relational formula of "(Pr·Nr)/

Hr>1.25 L+55", the shape of the furnace wall tube 35 is not limited to the shape of $F_2$ or $F_3$. That is, the shape of the furnace wall tube 35 may be a shape obtained by combining the shape of $F_2$ and the shape of $F_3$.

Figure 6:
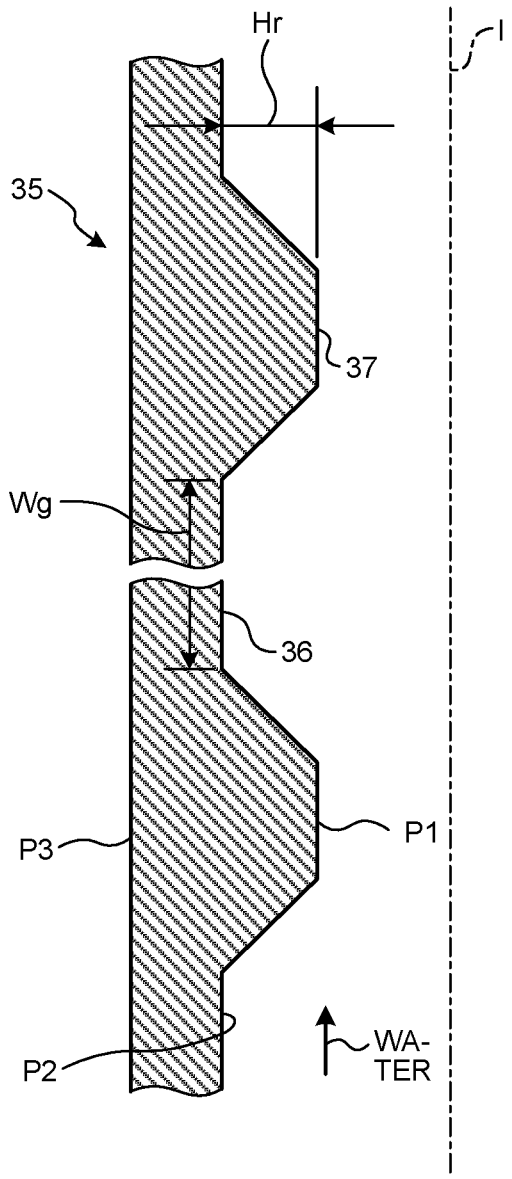
FIG. 6 is a partial cross-sectional view when taken along the tube axis direction illustrating an example of a shape of a rib portion of the furnace wall tube.

In the first embodiment, although the shape of the rib portion 37 of the furnace wall tube 35 is not particularly limited, for example, it may be a shape illustrated in FIG. 6. FIG. 6 is a partial cross-sectional view when taken along the tube axis direction illustrating an example of the shape of the rib portion of the furnace wall tube.

As illustrated in FIG. 6, in the rib portion 37 of the furnace wall tube 35, the cross-sectional shape when taken along the tube axis direction is formed in a trapezoidal shape in which an inner circumferential surface P2 is a bottom surface (lower base) and an inner circumferential surface P1 is an upper surface (upper base). Furthermore, in this case, as in the first embodiment, the rib height Hr of the rib portion 37 is a height from the inner circumferential surface P2 to a location at which the rib portion 37 is located on the radially innermost side (that is, the inner circumferential surface P1). Also, the groove width Wg is a width between a bent location as a boundary between the inner circumferential surface P2 and the rib portion 37 on one side in the tube axis direction of the groove portion 36, and a bent location as a boundary between the inner circumferential surface P2 and the rib portion 37 on the other side in the tube axis direction of the groove portion 36.

As illustrated in FIG. 6, the rib portion 37 of the furnace wall tube 35 may be a shape having a bent portion which has a predetermined angle with respect to the inner circumferential surface P1 and the inner circumferential surface P2. In addition, in FIG. 6, the rib portion 37 is formed in a trapezoidal shape, but it may be a rectangular shape or a triangular shape and is not particularly limited.

Figure 7:
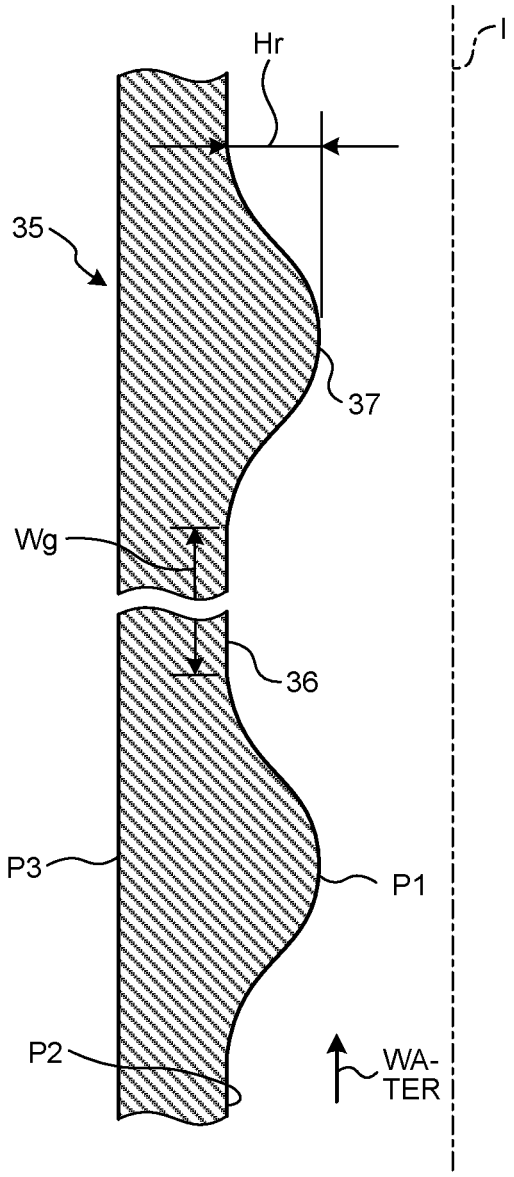
FIG. 7 is a partial cross-sectional view when taken along the tube axis direction illustrating an example of the shape of the rib portion of the furnace wall tube.

Furthermore, the shape of the rib portion 37 of the furnace wall tube 35 may be a shape illustrated in FIG. 7. FIG. 7 is a partial cross-sectional view when taken along the tube axis direction illustrating an example of the shape of the rib portion of the furnace wall tube.

As illustrated in FIG. 7, the rib portion 37 of the furnace wall tube 35 is configured so that the cross-sectional shape when taken along the tube axis direction is formed in a curved shape that continues with the inner circumferential surface P2 and is convex radially inward. Furthermore, in this case, as in the first embodiment, the rib height Hr of the rib portion 37 is a height from the inner circumferential surface P2 to a location (that is, top) at which the rib portion 37 is located on the radially innermost side. Also, the groove width Wg is a width between a boundary between the flat inner circumferential surface P2 and the curved rib portion 37 on one side in the tube axis direction of the groove portion 36, and a boundary between the flat inner circumferential surface P2 and the curved rib portion 37 on the other side in the tube axis direction of the groove portion 36.

As illustrated in FIG. 7, the rib portion 37 of the furnace wall tube 35 may be a shape having a continuous curved surface which has a predetermined radius of curvature with respect to the inner circumferential surface P1 and the inner circumferential surface P2. In FIG. 7, the rib portion 37 has a curved shape which is convex radially inward, but the radially inner top of the rib portion 37 may be a flat surface, and as long as it is a continuous curved surface with respect to the inner circumferential surface P1 and the inner circumferential surface P2, it is not particularly limited.

Figure 8:
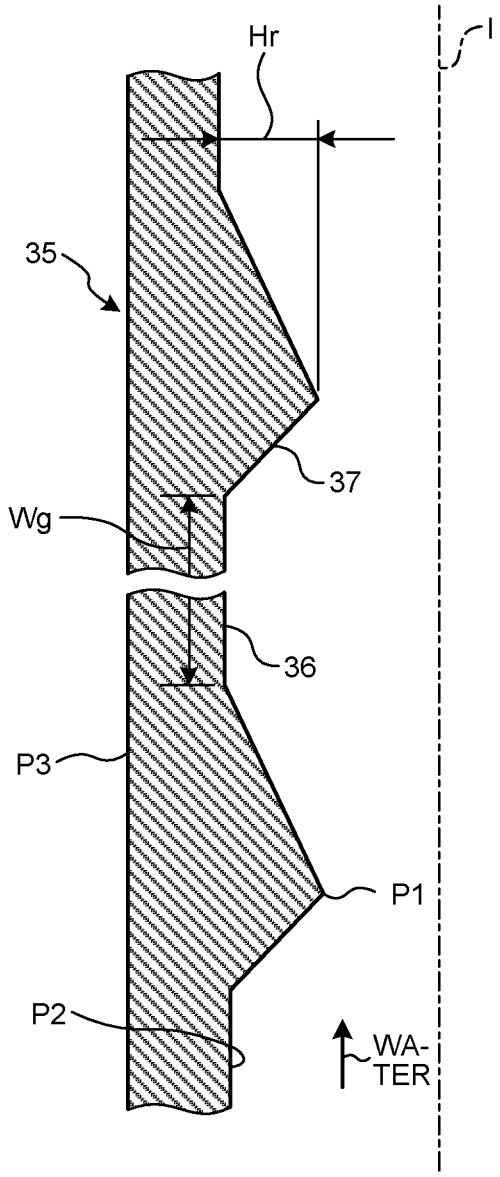
FIG. 8 is a partial cross-sectional view when taken along the tube axis direction illustrating an example of the shape of the rib portion of the furnace wall tube.
Figure 9:
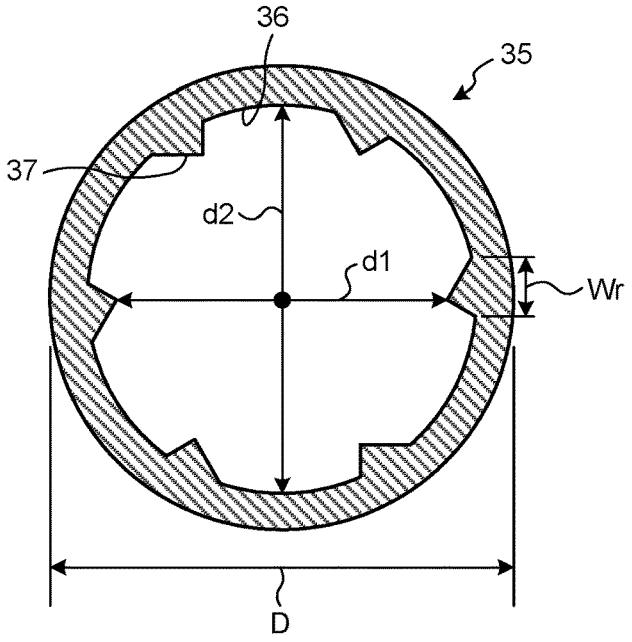
FIG. 9 is a partial cross-sectional view when taken along a plane perpendicular to the tube axis direction illustrating an example of the shape of the rib portion of the furnace wall tube.

Furthermore, the shape of the rib portion 37 of the furnace wall tube 35 may be a shape illustrated in FIGS. 8 and 9. FIG. 8 is a partial cross-sectional view when taken along the tube axis direction illustrating an example of the shape of the rib portion of the furnace wall tube, and FIG. 9 is a partial cross-sectional view when taken along the plane perpendicular to the tube axis direction illustrating an example of the shape of the rib portion of the furnace wall tube.

As illustrated in FIG. 8, in the rib portion 37 of the furnace wall tube 35, a cross-sectional shape when taken along the tube axis direction is formed in a triangular shape in which the inner circumferential surface P2 is a bottom surface. At this time, an angle formed between the rib portion 37 and the inner circumferential surface P2 differs on the upstream side and the downstream side in the flow direction of water. That is, the angle formed between the rib portion 37 and the inner circumferential surface P2 on the upstream side in the flow direction has a small angle, compared to an angle formed between the rib portion 37 and the inner circumferential surface P2 on the downstream side of the flow direction. That is, in the rib portion 37, with respect to the flow direction of water, the gradient of the location of the upstream side is steep, while the gradient of the location of the downstream side is slow.

In addition, as illustrated in FIG. 9, the rib portion 37 of the furnace wall tube 35 is configured so that the cross-sectional shape when taken along a plane perpendicular to the tube axis direction is formed in a triangular shape in which the inner circumferential surface P2 is a bottom surface. At this time, the angle formed between the rib portion 37 and the inner circumferential surface P2 differs on the upstream side and the downstream side in a turning direction of water. That is, the angle formed between the rib portion 37 and the inner circumferential surface P2 on the upstream side in the turning direction has a small angle, as compared to the angle formed between the rib portion 37 and the inner circumferential surface P2 on the downstream side in the turning direction. That is, in the rib portion 37, with respect to the turning direction of the water, the gradient of the location of the upstream side is steep, while the gradient of the location of the downstream side is slow.

Second Embodiment

Figure 10:
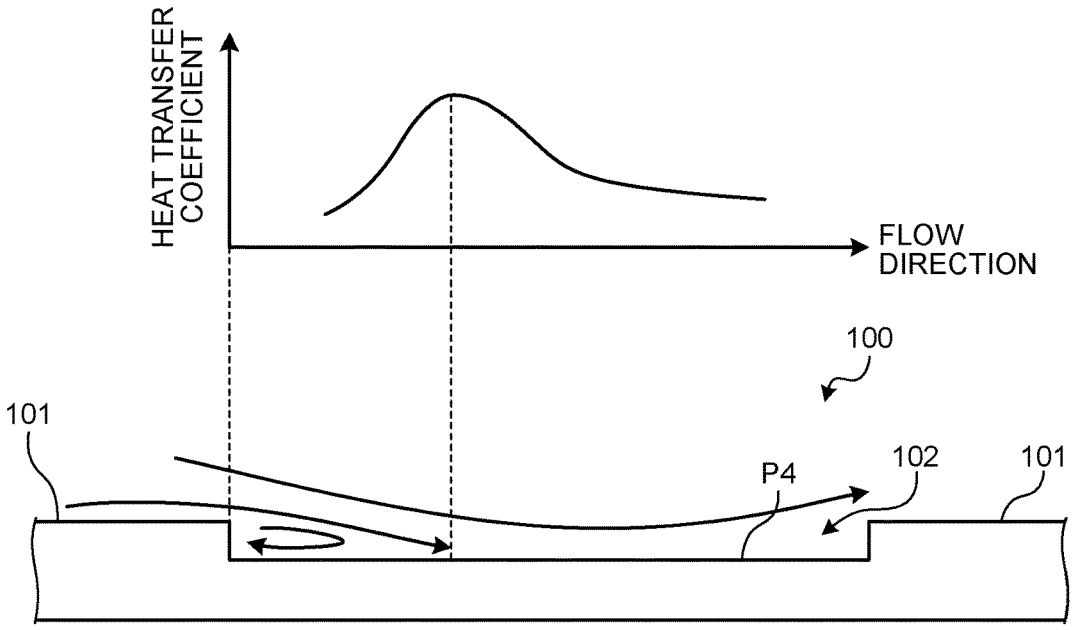
FIG. 10 is an explanatory view illustrating a relation between a flow (back-step flow) at the time of getting over a step and a heat transfer coefficient.
Figure 11:
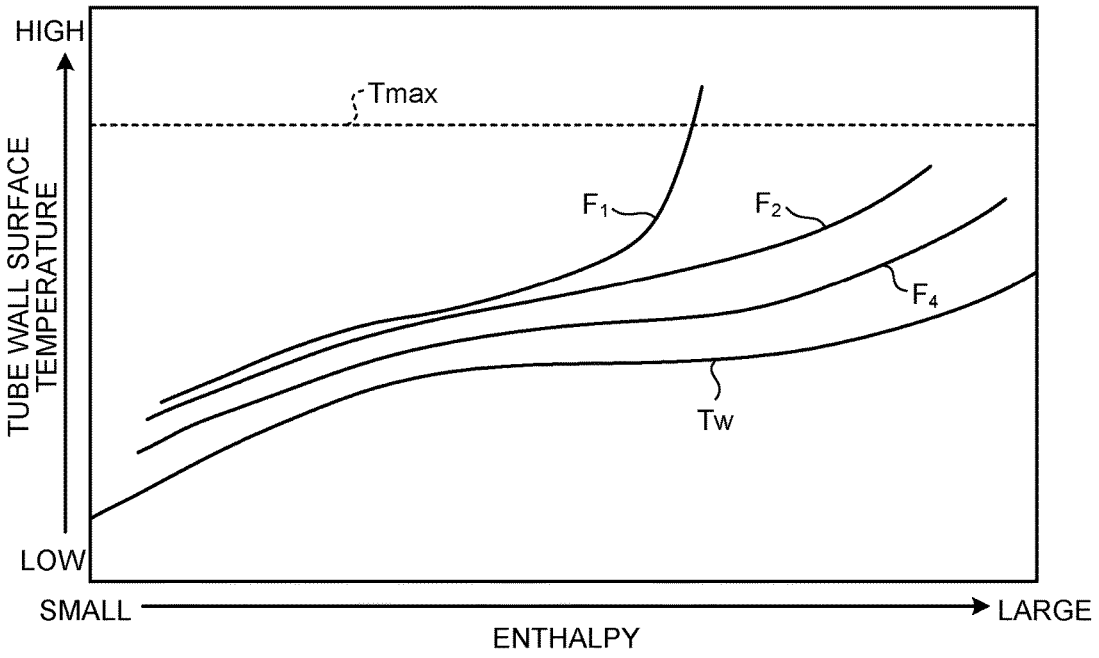
FIG. 11 is a graph of an example of the tube wall surface temperature of the furnace wall which varies depending on the enthalpy.
Figure 12:
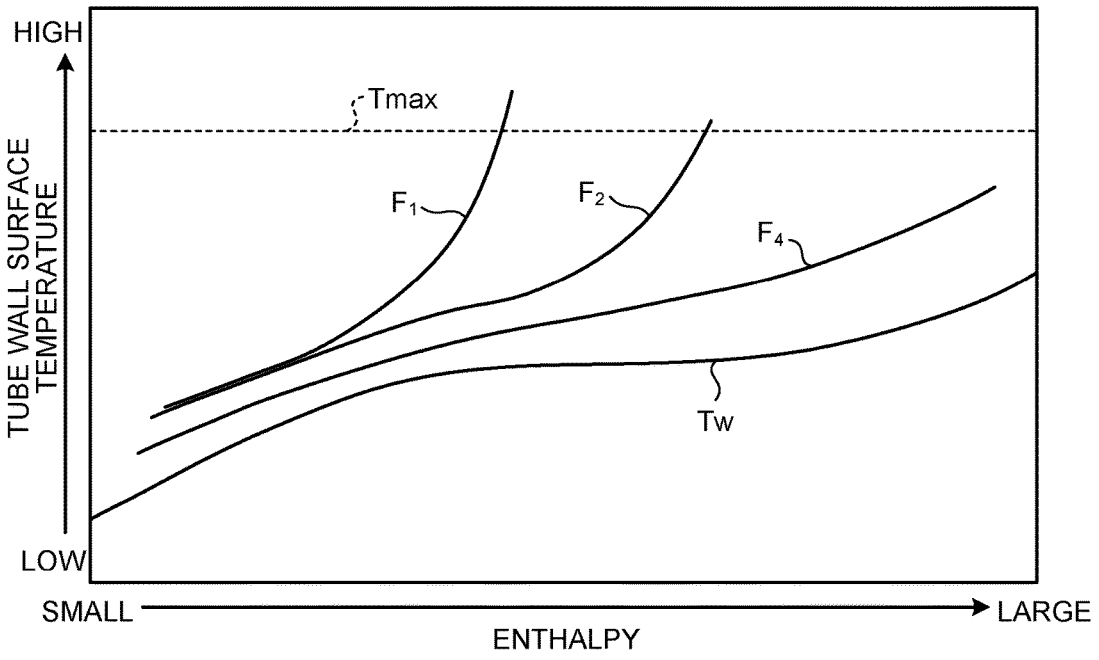
FIG. 12 is a graph of an example of the tube wall surface temperature of the furnace wall which varies depending on the enthalpy.
Figure 13:
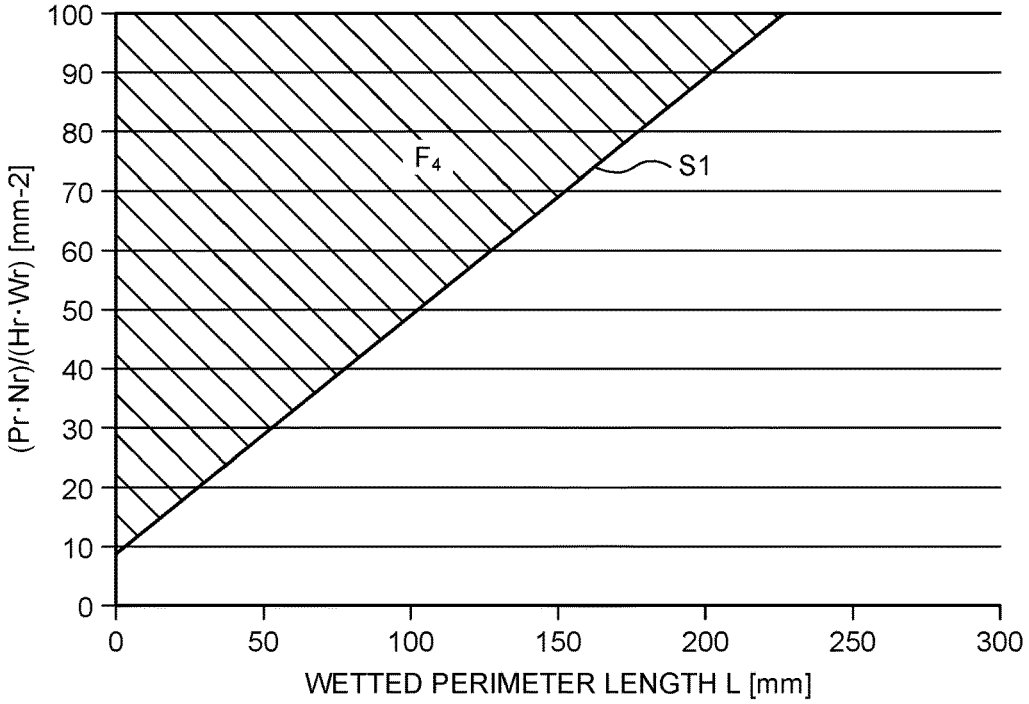
FIG. 13 is a graph illustrating a relation among a rib height Hr, a rib interval Pr, a rib width Wr and a rib number Nr, which varies depending on a wetted perimeter length L, in regard to a furnace wall tube of a second embodiment.

Next, a furnace wall tube 35 according to a second embodiment will be described referring to FIGS. 10 to 13. FIG. 10 is an explanatory view illustrating a relation between the flow at the time of getting over the step (back-step flow) and the heat transfer coefficient. FIG. 11 is a graph of an example of the tube wall surface temperature of the furnace wall that varies depending on the enthalpy. FIG. 12 is a graph of an example of the tube wall surface temperature of the furnace wall that varies depending on the enthalpy. FIG. 13 is a graph illustrating a relation among the rib height Hr, the rib interval Pr, the rib width Wr and the rib number Nr which varies depending on a wetted perimeter length L in regard to a furnace wall tube of the second embodiment. In addition, in the second embodiment, in order to avoid the repeated description, only the parts different from those of the first embodiment will be described, and the parts of the same configurations as those of the first embodiment are denoted by the same reference numerals. The shape of the furnace wall tube 35 according to the second embodiment will be described below.

The interior of the furnace wall tube 35 enters a state of supercritical pressure, and water flows in this state. At this time, the furnace wall tube 35 of the second embodiment heated by the combustor 22 has a shape with high heat transfer coefficient, while suppressing the heat transfer degradation phenomenon.

Incidentally, since the interior of the furnace wall tube 35 has a supercritical pressure, water flows in a single-phase state. Also, since water flows in the tube axis direction, the water becomes the flow that gets over the rib portion 37, while being given a turning force by the rib portion 37. At this time, the flow getting over the rib portion 37 is a so-called back-step flow. The relation between the back-step flow and the heat transfer coefficient will be described referring to FIG. 10.

FIG. 10 is an explanatory view illustrating a relation between the flow (back-step flow) at the time of getting over the step and the heat transfer coefficient. A flow passage 100 through which fluid flows illustrated in FIG. 10 is a flow passage in which a stepped portion 101 projects from the bottom surface P4. In addition, a location, at which the bottom surface P4 is formed, is a groove portion 102. Here, the flow passage 100 corresponds to the internal flow passage of the furnace wall tube 35. Moreover, the stepped portion 101 corresponds to the rib portion 37 of the furnace wall tube 35. Furthermore, the groove portion 102 corresponds to the groove portion 36 of the furnace wall tube 35. Furthermore, the fluid flowing through the flow passage 100 corresponds to the water as the heating medium. A predetermined flow direction of the flow of fluid corresponds to the tube axis direction of flow of water.

Here, when the fluid flows in a predetermined flow direction in the flow passage 100, the fluid flows on the stepped portion 101 and then separates at the corner portion of the stepped portion 101. The separated fluid reattaches to the bottom surface P4 of the groove portion 102 at the reattachment point O. Thereafter, the water reattaching to the bottom surface P4 of the groove portion 102 flows to the downstream side along the bottom surface P4.

At this time, the heat transfer coefficient of the bottom surface P4 in the predetermined flow direction is as illustrated in FIG. 10, the heat transfer coefficient is highest at the reattachment point O, and the heat transfer coefficient is lowered, as it goes away from the reattachment point O to the upstream side and the downstream side. For this reason, in order to improve the heat transfer coefficient of the furnace wall tube 35, it is necessary to properly adjust the position of the reattachment point O.

Here, the position of the reattachment point O can be adjusted by varying the rib height Hr and the rib width Wr. That is, it is possible to set the position of the reattachment point O to a position at which the heat transfer coefficient of the furnace wall tube 35 is high, by setting the rib height Hr and the rib width Wr to an optimum shape.

For this reason, the furnace wall tube 35 is formed in a shape in which the small inner diameter d1, the large inner diameter d2, the tube outer diameter D, the groove width Wg, the rib width Wr, the interval Pr, the rib number Nr, the rib height Hr and the wetted perimeter length L satisfy the relational formula described below.

In the furnace wall tube 35, the groove width Wg, the rib height Hr and the tube outer diameter D satisfy the relational formula "Wg/(Hr·D)>0.40" (hereinafter, referred to as Formula (1)). Here, when "Wg/(Hr·D)=F", the relation is "F>0.40". At this time, the rib height Hr is "Hr>0", and the rib portion 37 is configured to protrude radially inward. In addition, the rib height Hr, the rib interval Pr, the rib width Wr, the rib number Nr, and the wetted perimeter length L satisfy the relational formula "(Pr·Nr)/(Hr·Wr)>0.40 L+9.0" (hereinafter, referred to as Formula (2)). Although the details will be described below, by setting the shape of the furnace wall tube 35 to a shape that satisfies the above-described two relational formulas, it is possible to improve the heat transfer coefficient, while suppressing the occurrence of the heat transfer degradation phenomenon.

The lead angle of the rib portion 37 having a spiral shape becomes an angle that satisfies the above-mentioned relational formula. In addition, the lead angle is an angle with respect to the tube axis direction, if the lead angle of the rib portion 37 is 0°, it becomes a direction along the tube axis direction, and if the lead angle of the rib portion 37 is 90°, it becomes a direction along the circumferential direction. Here, the lead angle of the rib portion 37 is also appropriately changed depending on the number of the rib portions 37. That is, if the number of the rib portions 37 is large, the lead angle of the rib portion 37 becomes a gentle angle (approaching 0°), and meanwhile, if the number of the rib portions 37 is small, the lead angle of the rib portion 37 becomes a steep angle (approaching 90°).

Next, the changes in tube wall surface temperature of the furnace wall that varies depending on the enthalpy will be described referring to FIGS. 11 and 12. FIGS. 11 and 12 are graphs of an example of the tube wall surface temperature of the furnace wall that varies depending on the enthalpy. Here, the horizontal axes of FIGS. 11 and 12 are enthalpy that is given to the furnace wall 31 (furnace wall tube 35), and the vertical axes thereof are the tube wall surface temperature (temperature of the furnace wall tube 35).

As illustrated in FIGS. 11 and 12, $F_1$ is a graph illustrating changes in the tube wall surface temperature at the time of "F=0.35", and has a shape of the conventional furnace wall tube 35 which does not satisfy the relational formula of the first embodiment. Furthermore, $F_2$ is a graph illustrating changes in the tube wall surface temperature at the time of "F>0.40", and has a shape of the furnace wall tube 35 which satisfies the Formula (1) of the second embodiment. In addition, $F_4$ is a graph illustrating changes in the tube wall surface temperature at the time of satisfying the two relational formulas of "F>0.40" and "(Pr·Nr)/(Hr·Wr)>0.40 L+9.0", and has a shape of the furnace wall tube 35 that satisfies the two relational formulas of the second embodiment. In addition, $T_w$ is a graph illustrating changes in temperature (fluid temperature) of the water flowing through the interior of the furnace wall tube 35, and $T_{max}$ is a critical tube temperature that is acceptable for the furnace wall tube 35.

Here, in FIG. 11, the mass velocity of water flowing through the interior of the furnace wall tube 35 becomes a low mass velocity at which flow stability of water inside the furnace wall tube 35 can be secured, and the interior of the furnace wall tube 35 has a supercritical pressure. Specifically, although the low mass velocity differs depending on the sizes of the tube outer diameter D, the small inner diameter d1 and the large inner diameter d2, for example, when operating the boiler 10 at the rated output, the average mass velocity of the furnace wall tube 35 is in the range of 1000 (kg/m$^2$s) or more and 2000 (kg/m$^2$s) or less. In addition, as long as the mass velocity is achieved at which the flow stability of water inside the furnace wall tube 35 can be secured, it is not limited to the above-described range. Moreover, in the second embodiment, the rated output becomes a rated electric power in the generator of the thermal power plant 1.

As illustrated in FIG. 11, in the case of $F_1$, it is recognized that when the enthalpy increases, that is, when the amount of heat given to the furnace wall tube 35 increases, the tube wall surface temperature transiently increases. That is, in the case of $F_1$, it was checked that when the amount of heat given to the furnace wall tube 35 increases, the heat transfer degradation phenomenon occurs in which the heat transfer coefficient decreases during supercritical pressure.

Meanwhile, as illustrated in FIG. 11, in the case of $F_2$, it is recognized that when the enthalpy increases, that is, when the amount of heat given to the furnace wall tube 35 increases, the tube wall surface temperature gradually increases compared to the case of $F_1$. That is, in the case of $F_2$, it was checked that even when the amount of heat given to the furnace wall tube 35 increases, the decrease in the heat transfer coefficient during supercritical pressure is suppressed, and it is possible to suppress the occurrence of the heat transfer degradation phenomenon in the furnace wall tube 35. That is, it was checked that the shape of the furnace wall tube 35 which satisfies the Formula (1) can suppress the occurrence of the heat transfer degradation phenomenon.

Furthermore, as illustrated in FIG. 11, in the case of $F_4$, it is recognized that the tube wall surface temperature decreases compared to the case of $F_2$ from small enthalpy to large enthalpy. That is, in the case of $F_4$, it was checked that the heat transfer coefficient of the furnace wall tube 35 is improved compared to the case of $F_2$ regardless of the magnitude of the amount of heat given to the furnace wall tube 35, and even when the amount of heat given to the furnace wall tube 35 increases, the decrease in the heat transfer coefficient during supercritical pressure is also suppressed, and it is possible to suppress the occurrence of the heat transfer degradation phenomenon in the furnace wall tube 35. That is, it was checked that the shape of the furnace wall tube 35 satisfying the Formulas (1) and (2) can improve the heat transfer coefficient, while suppressing the occurrence of the heat transfer degradation phenomenon.

Next, in FIG. 12, the mass velocity of the water flowing through the interior of the furnace wall tube 35 becomes slower than the case of FIG. 11, and becomes a minimum (lower limit) mass velocity at which the boiler 10 can be operated. Furthermore, as in FIG. 11, the interior of the furnace wall tube 35 has a supercritical pressure. Specifically, although the minimum mass velocity differs depending on the sizes of the tube outer diameter D, the small inner diameter d1 and the large inner diameter d2, for example, when operating the boiler 10 at the rated output, the average mass velocity of the furnace wall tube 35 is in the range of 1500 ($kg/m^2s$) or less. In addition, as long as the minimum mass velocity is set at which the boiler 10 can be operated, it is not limited to the above-described range, and the general lower limit is about 700 $kg/m^2s$.

As illustrated in FIG. 12, in the case of $F_1$, it is recognized that when the enthalpy increases, that is, when the amount of heat given to the furnace wall tube 35 increases, the tube wall surface temperature transiently increases. That is, in the case of $F_1$, it was checked that when the heating medium flows through the interior of the furnace wall tube 35 at the minimum mass velocity and the amount of heat given to the furnace wall tube 35 increases, the heat transfer degradation phenomenon occurs in which the heat transfer coefficient decreases during supercritical pressure.

Meanwhile, as illustrated in FIG. 12, in the case of $F_2$, it is recognized that when the enthalpy increases, that is, when the amount of heat given to the furnace wall tube 35 increases, the tube wall surface temperature gradually increases as compared to the case of $F_1$ but exceeds the critical tube temperature $T_{max}$.

In contrast, as illustrated in FIG. 12, in the case of $F_4$, it was checked that the tube wall surface temperature decreases from small enthalpy to large enthalpy as compared to the case of $F_2$. That is, in the case of $F_4$, it was checked that the heat transfer coefficient of the furnace wall tube 35 is improved compared to the case of $F_2$, regardless of the amount of heat given to the furnace wall tube 35. Furthermore, it was checked that even when the heating medium flows through the interior of the furnace wall tube 35 at the minimum mass velocity and the amount of heat given to the furnace wall tube 35 is large, the decrease in the heat transfer coefficient during supercritical pressure is suppressed, and it is possible to suppress the occurrence of the heat transfer degradation phenomenon in the furnace wall tube 35. That is, it was checked that the shape of the furnace wall tube 35 satisfying the Formulas (1) and (2) can improve the heat transfer coefficient, while suppressing the occurrence of the heat transfer degradation phenomenon.

Next, a relation between a graph illustrating the relation among the rib height Hr, the rib interval Pr, the rib width Wr and the rib number Nr, and the location according to $F_4$, which varies depending on the wetted perimeter length L, will be described referring to FIG. 13. FIG. 13 is a graph illustrating a relation among the rib height Hr, the rib interval Pr, the rib width Wr and the rib number Nr, which varies depending on the wetted perimeter length L in regard to the furnace wall tube of the second embodiment. In the graph of FIG. 13, the horizontal axis is a wetted perimeter length L, and a vertical axis is "(Pr·Nr)/(Hr·Wr)".

S1 illustrated in FIG. 13 is a line of "(Pr·Nr)/(Hr·Wr) =0.40 L+9.0", and a region according to $F_4$ becomes a region in which the value of (Pr·Nr)/(Hr·Wr) becomes a value greater than S1. That is, the furnace wall tube 35 of the second embodiment can have a shape that can improve the heat transfer coefficient, while suppressing the occurrence of the heat transfer degradation phenomenon, by setting the rib height Hr, the rib interval Pr, the rib width Wr, the rib number Nr and the wetted perimeter length L to shapes that fall within the region of $F_4$.

As described above, according to the configuration of the second embodiment, in the furnace wall tube 35 in which the interior has a supercritical pressure, by satisfying "Wg/(Hr·D)>0.40" and "(Pr·Nr)/(Hr·Wr)>0.40 L+9.0", it is possible to improve the heat transfer coefficient, while suppressing the occurrence of the heat transfer degradation phenomenon. For this reason, by improving the heat transfer coefficient during supercritical pressure, while suppressing the occurrence of the heat transfer degradation phenomenon, it is possible to suppress the increase in the tube temperature (tube wall surface temperature of the furnace wall 31), over the magnitude of entropy.

Furthermore, according to the configuration of the second embodiment, even when water flowing through the interior of the furnace wall tube 35 is low mass velocity (average mass velocity is 1000 to 2000 $kg/m^2s$), high heat flux is applied thereto, or the mass velocity of water flowing through the interior of the furnace wall tube 35 is lowered (average mass velocity is equal to or less than 1500 $kg/m^2s$), it is possible to improve the heat transfer coefficient during supercritical pressure, while suppressing the occurrence of the heat transfer degradation phenomenon.

Furthermore, according to the configuration of the second embodiment, the furnace wall tube 35 satisfying the above-mentioned relational formula can be applied to a supercritical pressure variable pressure operation boiler of a vertical tubular furnace type. For this reason, since it is possible to suppress the occurrence of the heat transfer degradation phenomenon of the furnace wall tube 35 during supercritical pressure, it is possible to suitably maintain the heat transfer from the furnace wall tube 35 to water, and the steam can be stably generated.

Furthermore, according to the configuration of the second embodiment, the boiler 10 having the furnace wall tube 35 can be applied to the thermal power plant 1 that uses the steam turbine 11. Therefore, since the steam can be stably generated in the boiler 10, it is possible to stably supply the seam toward the steam turbine 11, and thus, the steam turbine 11 can also be stably operated.

In the second embodiment, although the furnace wall tube 35 serving as a heat transfer tube is applied to a conventional boiler and the conventional boiler is applied to the thermal power plant 1, the present invention is not limited to this configuration. For example, the heat transfer tube which satisfies the above-mentioned relational formula may be applied to an exhausted heat recovery boiler, and the exhausted heat recovery boiler may be applied to an integrated coal gasification combined cycle (IGCC) device. That is, as long as a once-through boiler is adopted in which the interior of the heat transfer tube has a supercritical pressure, the heat transfer tube can be applied to any boiler.

Furthermore, although the shape of the rib portion 37 of the furnace wall tube 35 is not particularly limited in the second embodiment, for example, as in the first embodiment, it may have the shape as illustrated in FIGS. 6 to 9.

Third Embodiment

Figure 14:
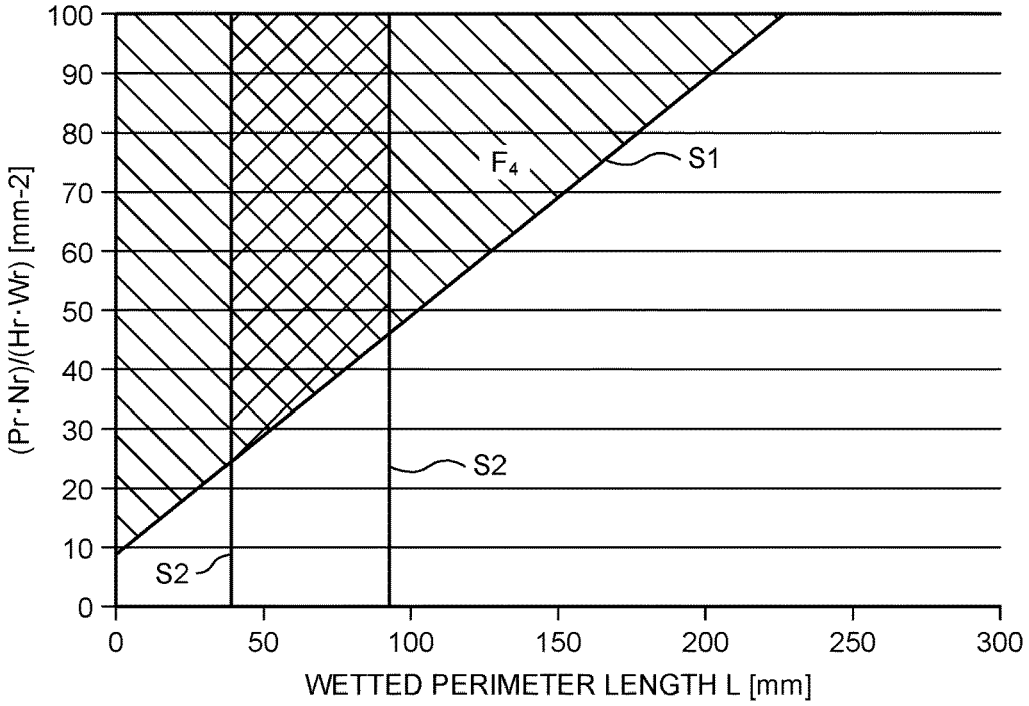
FIG. 14 is a graph illustrating a relation among a rib height Hr, a rib interval Pr, a rib width Wr and a rib number Nr, which varies depending on a wetted perimeter length L in regard to a furnace wall tube of a third embodiment.

Next, the furnace wall tube 35 according to a third embodiment will be described referring to FIG. 14. FIG. 14 is a graph illustrating a relation among the rib height Hr, the rib interval Pr, the rib width Wr and the rib number Nr, which varies depending on the wetted perimeter length L according to the furnace wall tube of the third embodiment. In addition, even in the third embodiment, in order to avoid the repeated description, only the parts different from those of the first and second embodiments will be described, and parts of the same configurations as those of the first and second embodiments are denoted by the same reference numerals. Although the tube outer diameter D is not particularly mentioned in the second embodiment, the tube outer diameter D of the furnace wall tube 35 is formed to be "25 mm≤D≤35 mm" in the third embodiment. The furnace wall tube 35 according to the third embodiment will be described below.

As described in the second embodiment, the average mass velocity of water flowing through the interior of the furnace wall tube 35 is in the range of 1000 ($kg/m^2s$) or more and 2000 ($kg/m^2s$) or less, or is 1500 ($kg/m^2s$) or less and equal to or greater than the minimum mass velocity at which the boiler 10 can be operated. In this way, the mass velocity of the water flowing through the interior of the furnace wall tube 35 becomes a preset mass velocity. The reason is that, in order to achieve an optimum heat transfer coefficient of the furnace wall tube 35 that satisfies Formula (1) and Formula (2), by setting the mass velocity within the above-described range, the position of the reattachment point O illustrated in FIG. 10 is set to the optimum position. At this time, when the tube outer diameter D of the furnace wall tube 35 decreases, the mass flow velocity increases, and meanwhile, when the tube outer diameter D increases, the mass flow velocity decreases. Here, when the size of the tube outer diameter D of the furnace wall tube 35 is too large or too small, the mass flow velocity departs from the above-described range, whereby the position of the reattachment point O illustrated in FIG. 10 may change from the optimum position. For this reason, in order to achieve the mass flow velocity that is suitable for the shape of the furnace wall tube 35 that satisfies Formula (1) and Formula (2), the tube outer diameter D of the furnace wall tube 35 becomes a range to be described below.

In the third embodiment, the tube outer diameter D of the furnace wall tube 35 is formed to be "25 mm≤D≤35 mm". Here, as illustrated in FIG. 14, the region defined by the tube outer diameter D of the range of "25 mm≤D≤35 mm" is a region that is interposed by two lines S2. That is, the wetted perimeter length L is defined by a function of the tube outer diameter D as a factor, when the tube outer diameter D increases, the wetted perimeter length L increases, and when the tube outer diameter D decreases, the wetted perimeter length L decreases. Moreover, in the two lines S2, the left line S2 of FIG. 14 is a line of the tube outer diameter "D=25 mm" and a right line S2 of FIG. 14 is a line of the tube outer diameter "D=35 mm". Moreover, the furnace wall tube 35 of the third embodiment has a shape in which the rib height Hr, the rib interval Pr, the rib width Wr, the rib number Nr and the wetted perimeter length L fall within an overlapped region in which the region of $F_4$ defined by the line S1 and the region interposed by the two lines S2 overlap each other.

As described above, according to the configuration of the third embodiment, by setting the tube outer diameter D to "25 mm≤D≤35 mm", the mass flow velocity of water can be set to the above-described range, and the mass flow velocity of water can be set to a suitable mass flow velocity. Therefore, since it is possible to achieve the mass flow velocity that is suitable for the shape of the furnace wall tube 35 which satisfies Formula (1) and Formula (2), the position of the reattachment point O can be set to an optimum position, and the optimum performance of the heat transfer coefficient can be achieved.

Fourth Embodiment

Figure 15:
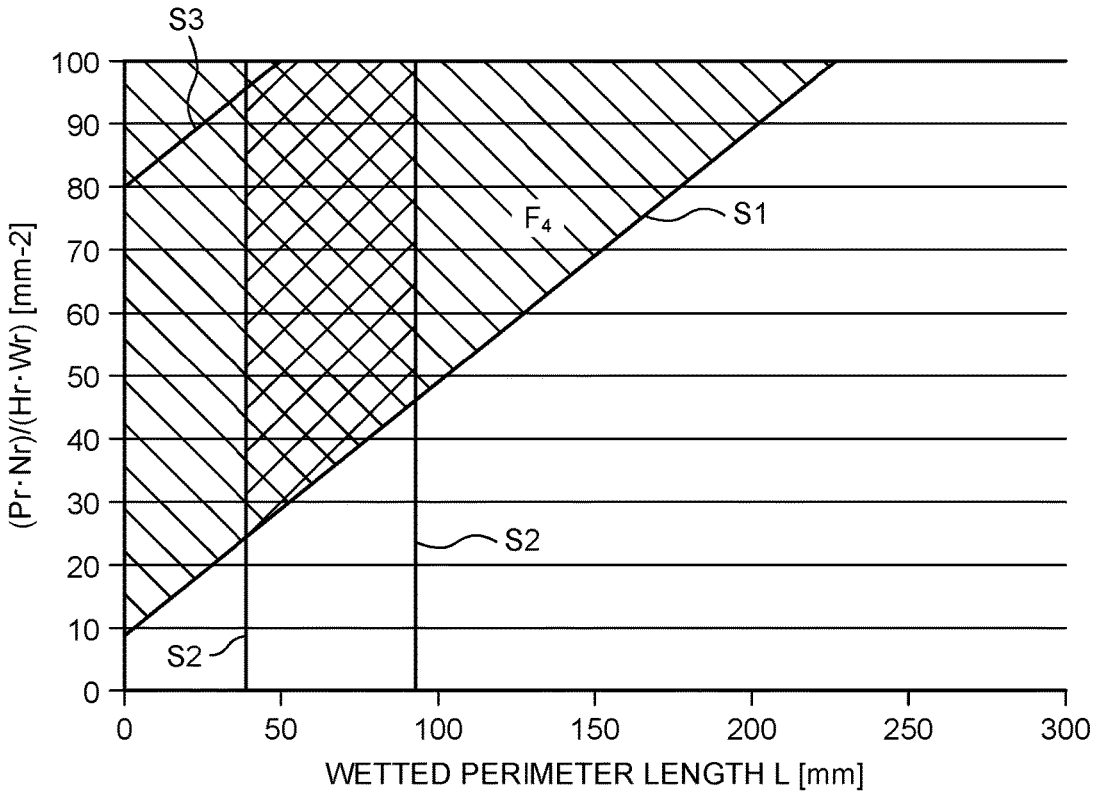
FIG. 15 is a graph illustrating a relation among the rib height Hr, the rib interval Pr, the rib width Wr and the rib number Nr, which varies depending on the wetted perimeter length L in regard to a furnace wall tube of a fourth embodiment.

Next, a furnace wall tube 35 according to a fourth embodiment will be described referring to FIG. 15. FIG. 15 is a graph illustrating a relation among the rib height Hr, the rib interval Pr, the rib width Wr and the rib number Nr, which vary depending on the wetted perimeter length L, in regarding to the furnace wall tube of the fourth embodiment. In addition, even in the fourth embodiment, in order to avoid the repeated description, the parts different from those of the first to third embodiments will be described, and parts of the same configurations as those of the first to third embodiments are denoted by the same reference numerals. In the fourth embodiment, an upper limit value is provided in Formula (2). The furnace wall tube 35 according to the fourth embodiment will be described below.

In the furnace wall tube 35 of the fourth embodiment, the rib height Hr, the rib interval Pr, the rib width Wr, the rib number Nr and the wetted perimeter length L satisfy the relational formula of "(Pr·Nr)/(Hr·Wr)<0.40 L+80" (hereinafter, referred to as Formula (3)), in addition to Formula (1) and Formula (2). That is, the furnace wall tube 35 of the third embodiment becomes in the range of "0.40 L+9.0<(Pr·Nr)/(Hr·Wr)<0.40 L+80" when Formula (2) and Formula (3) are combined with each other.

Here, in Formula (2), that is, in the formula of "(Pr·Nr)/(Hr·Wr)>0.40 L+9.0", since the upper limit of "(Pr·Nr)/(Hr·Wr)" is not set, when the formula of the left side extremely increases, a direction is obtained in which the rib interval Pr is widened, the rib number Nr increases, the rib height Hr becomes zero, and the rib width Wr becomes zero. In this case, it is not easy to maintain the shape of the furnace wall tube 35.

Therefore, in the fourth embodiment 4, an upper limit value is set in Formula (3). Here, as illustrated in FIG. 15, a line S3 is "(Pr·Nr)/(Hr·Wr)=0.40 L+80". Moreover, the furnace wall tube 35 of the fourth embodiment has a shape in which the rib height Hr, the rib interval Pr, the rib width Wr, the rib number Nr and the wetted perimeter length L fall within the overlapped region in which the region of $F_4$ defined by the line S1, the region interposed by the two lines S2, and a region smaller than the line S3 overlap one another. That is, the furnace wall tube 35 of the fourth embodiment has the rib height Hr, the rib interval Pr, the rib width Wr, the rib number Nr, and the wetted perimeter length L in the region surrounded by the line S1, the two lines S2 and the line S3.

As described above, according to the configuration of the fourth embodiment, by defining the upper limit value by Formula (3), it is possible to easily maintain the furnace wall tube 35 to a suitable shape without diverging the rib height Hr, the rib interval Pr, the rib width Wr, the rib number Nr, and the wetted perimeter length L.

In the first to fourth embodiments, although the turning direction of the groove portion 36 and the rib portion 37 having the spiral shape is not particularly limited, the turning direction may be a clockwise direction, may be a counter-clockwise direction, and is not particularly limited.

REFERENCE SIGNS LIST

1 THERMAL POWER PLANT
10 BOILER
11 STEAM TURBINE
21 FURNACE
22 COMBUSTOR
31 FURNACE WALL
35 FURNACE WALL TUBE
36 GROOVE PORTION
37 RIB PORTION
100 FLOW PASSAGE
101 STEPPED PORTION
102 GROOVE PORTION
D TUBE OUTER DIAMETER
d1 SMALL INNER DIAMETER
d2 LARGE INNER DIAMETER
Wg GROOVE WIDTH
Wr RIB WIDTH
Hr RIB HEIGHT
P1 INNER CIRCUMFERENTIAL SURFACE
P2 INNER CIRCUMFERENTIAL SURFACE
P3 OUTER CIRCUMFERENTIAL SURFACE
P4 BOTTOM SURFACE
L WETTED PERIMETER LENGTH
O REATTACHMENT POINT

The invention claimed is:

1. A heat transfer tube for a boiler, an interior of the heat transfer tube being configured to have a heating medium flow therethrough, the heat transfer tube comprising:

a groove portion that is defined on an inner circumferential surface and has a spiral shape extending continuously toward a tube axis direction; and a rib portion that extends continuously and protrudes inward in a radial direction by the groove portion of the spiral shape, wherein, in a cross section taken along the tube axis direction, a width [mm] of the groove portion in the tube axis direction is defined as Wg, a height [mm] of the rib portion in the radial direction is defined as Hr, and a tube outer diameter [mm] is defined as D, wherein the width Wg [mm] of the groove portion, the height Hr [mm] of the rib portion, and the tube outer diameter D [mm] satisfy "Wg/(Hr·D)>0.40", wherein the interior of the heat transfer tube has a supercritical pressure, wherein, an interval [mm] of the rib portion in the tube axis direction is defined as Pr, the number of the rib portion in a cross section which is taken perpendicularly to the tube axis direction is defined as Nr, and a wetted perimeter length [mm] of the cross section which is taken perpendicularly to the tube axis direction is defined as L, and wherein the height Hr [mm] of the rib portion, the interval Pr [mm] of the rib portion, the number of the rib portion Nr and the wetted perimeter length L [mm] satisfy "(Pr·Nr)/Hr>1.25L+55".

2. The heat transfer tube according to claim 1, wherein, when the boiler is operated at a rated output, an average mass velocity of the heating medium flowing through the interior of the heat transfer tube becomes 1000 to 2000 $kg/m^2s$.

3. The heat transfer tube according to claim 1, wherein, when the boiler is operated at a rated output, an average mass velocity of the heating medium flowing through the interior of the heat transfer tube is equal to or less than 1500 $kg/m^2s$.

4. The heat transfer tube according to claim 1, wherein the tube outer diameter D [mm] is "25 mm≤D≤40 mm".

5. The heat transfer tube according to claim 1, wherein, a width [mm] of the rib portion in a circumferential direction of the inner circumferential surface is defined as Wr, and wherein the height Hr [mm] of the rib portion, the interval Pr [mm] of the rib portion, the width Wr [mm] of the rib portion, the number Nr of the rib portion and the wetted perimeter length L [mm] satisfy "(Pr·Nr)/(Hr·Wr)<0.40L+80".

6. A boiler comprising the heat transfer tube according to claim 1 that is configured as a furnace wall tube that defines a furnace wall of the boiler.

7. A boiler configured to heat the heating medium flowing through the interior of the heat transfer tube according to claim 1, by heating the heat transfer tube by radiation of flame or high-temperature gas.

8. A steam turbine device comprising:

the boiler according to claim 6; and a steam turbine configured to be operated by steam generated by heating of water as the heating medium which flows through the interior of the heat transfer tube in the boiler.

9. The heat transfer tube according to claim 2, wherein the tube outer diameter D [mm] is "25 mm≤D≤40 mm".

10. A heat transfer tube for a boiler, an interior of the heat transfer tube being configured to have a heating medium flow therethrough, the heat transfer tube comprising:

a groove portion that is defined on an inner circumferential surface and has a spiral shape extending continuously toward a tube axis direction; and a rib portion that extends continuously and protrudes inward in a radial direction by the groove portion of the spiral shape, wherein, a height [mm] of the rib portion in the radial direction is defined as Hr, an interval [mm] of the rib portion in the tube axis direction is defined as Pr, the number of the rib portion in a cross section which is taken perpendicularly to the tube axis direction is defined as Nr, and a wetted perimeter length [mm] of the cross section which is taken perpendicularly to the tube axis direction is defined as L, wherein the height Hr [mm] of the rib portion, the interval Pr [mm] of the rib portion, the number Nr of the rib portion and the wetted perimeter length L [mm] satisfy "(Pr·Nr)/Hr>1.25L+55", and wherein the interior of the heat transfer tube has a supercritical pressure.

11. The heat transfer tube according to claim 10, wherein, when the boiler is operated at a rated output, an average mass velocity of the heating medium flowing through the interior of the heat transfer tube is equal to or less than 1500 $kg/m^2s$.

12. The heat transfer tube according to claim 10, wherein, when the boiler is operated at a rated output, an average mass velocity of the heating medium flowing through the interior of the heat transfer tube becomes 1000 to 2000 $kg/m^2s$.

13. The heat transfer tube according to claim 10, wherein the tube outer diameter D [mm] is "25 mm<D<40 mm".

14. A heat transfer tube for a boiler, an interior of the heat transfer tube being configured to have a heating medium flow therethrough, the heat transfer tube comprising:

a groove portion that is defined on an inner circumferential surface and has a spiral shape extending continuously toward a tube axis direction; and a rib portion that extends continuously and protrudes inward in a radial direction by the groove portion of the spiral shape, wherein, a height [mm] of the rib portion in the radial direction is defined as Hr, an interval [mm] of the rib portion in the tube axis direction is defined as Pr, a width [mm] of the rib portion in a circumferential direction of the inner circumferential surface is defined as Wr, the number of the rib portion in a cross section which is taken perpendicularly to the tube axis direction is defined as Nr, a wetted perimeter length [mm] of the cross section which is taken perpendicularly to the tube axis direction is defined as L, a width [mm] of the groove portion in the tube axis direction of a cross section which is taken along the tube axis direction is defined as Wg, and a tube outer diameter [mm] is defined as D, wherein the width Wg [mm] of the groove portion, the height Hr [mm] of the rib portion, and the tube outer diameter D [mm] satisfy "Wg/(Hr·D)>0.40", wherein the height Hr [mm] of the rib portion, the interval Pr [mm] of the rib portion, the width Wr [mm] of the rib portion, the number Nr of the rib portion and the wetted perimeter length L [mm] satisfy "(Pr·Nr)/(Hr·Wr)>0.40L+9.0" and wherein the interior of the heat transfer tube has a supercritical pressure.

15. The heat transfer tube according to claim 14, wherein, when the boiler is operated at a rated output, an average mass velocity of the heating medium flowing through the interior of the heat transfer tube becomes 1000 to 2000 $kg/m^2s$.

16. The heat transfer tube according to claim 14, wherein, when the boiler is operated at a rated output, an average mass velocity of the heating medium flowing through the interior of the heat transfer tube is equal to or less than 1500 $kg/m^2s$.

17. The heat transfer tube according to claim 15, wherein the tube outer diameter D [mm] is "25 mm≤D≤35 mm".

* * * * *